US009161639B1

(12) United States Patent
Hundley et al.

(10) Patent No.: US 9,161,639 B1
(45) Date of Patent: Oct. 20, 2015

(54) FOLDING BREATH GUARD

(71) Applicant: The Vollrath Company, L.L.C., Sheboygan, WI (US)

(72) Inventors: Jill Eileen Hundley, Sheboygan, WI (US); Ralph D. Shillingburg, Fitchburg, WI (US); Vincent J. Tagliarino, Sun Prairie, WI (US)

(73) Assignee: The Vollrath Company, L.L.C., Sheboygan, WI (US)

( * ) Notice: Subject to any disclaimer, the term of this patent is extended or adjusted under 35 U.S.C. 154(b) by 0 days.

(21) Appl. No.: 14/274,135

(22) Filed: May 9, 2014

(51) Int. Cl.

| | |
|---|---|
| ***A47F 10/06*** | (2006.01) |
| ***A47F 9/00*** | (2006.01) |
| ***A47F 3/00*** | (2006.01) |

(52) U.S. Cl.

CPC ..... *A47F 10/06* (2013.01); *A47F 3/007* (2013.01); *A47F 9/00* (2013.01); *A47F 2003/008* (2013.01); *A47F 2010/065* (2013.01)

(58) Field of Classification Search

CPC ..... A47F 3/004; A47F 3/005; A47F 3/007; A47F 3/0439; A47F 3/0447; A47F 3/12; A47F 3/02; A47F 3/04; A47F 3/0452; A47F 3/0456; A47F 3/0465; A47F 3/0469; A47F 3/0478; A47F 3/125; A47F 9/00; A47F 5/005; A47F 2003/005; A47F 2003/04; A47F 2003/0439; A47F 2009/00; A47F 2010/02; A47F 2010/06; A47F 2010/065; A47B 95/043; A47B 2031/002; A47B 2031/008; A47B 47/00; A47B 47/0025; A47B 96/00; A47B 96/04; A47B 96/06; A47B 96/061; A47B 96/062; A47B 96/063; A47B 96/14; A47B 96/1416; A47B 13/08; A47B 21/03; A47B 31/02; A47B 33/00; A47B 71/00; A47B 2013/08; A47B 2021/03; A47B 2031/02; A47B 2200/0036; A47B 2200/0038

USPC ..... 312/137, 140.1, 140.3, 140.4, 229, 258, 312/284, 285, 286, 287, 289, 114, 210

See application file for complete search history.

(56) References Cited

U.S. PATENT DOCUMENTS

| | | | | |
|---|---|---|---|---|
| 5,020,684 | A * | 6/1991 | Jow | 220/4.24 |
| 5,082,334 | A | 1/1992 | Beyer et al. | |
| 5,281,016 | A * | 1/1994 | Brague | 312/140.2 |
| 2003/0106471 | A1* | 6/2003 | Rivers | 108/90 |
| 2006/0175940 | A1* | 8/2006 | English | 312/137 |
| 2007/0090733 | A1* | 4/2007 | Matus | 312/140.4 |
| 2011/0080075 | A1* | 4/2011 | Matus, Jr. | 312/140.4 |
| 2011/0193453 | A1* | 8/2011 | Matus, Jr. | 312/140.4 |
| 2012/0056441 | A1* | 3/2012 | Chavarria et al. | 294/106 |

OTHER PUBLICATIONS

Vollrath'S New NSF2 Compliant Breath Guard Offering, Vollrath Company Press Release; dated Feb. 10, 2011, Sheboygan, WI. 3 pages.

* cited by examiner

*Primary Examiner* — Daniel J Troy
*Assistant Examiner* — Andrew Roersma
(74) *Attorney, Agent, or Firm* — Foley & Lardner LLP

(57) ABSTRACT

A folding breath guard configured to at least partially cover food in a foodservice area includes a top panel, a first side panel, a first hinge rotatably coupling the first side panel to the top panel, wherein the first side panel is movable between an extended position and a storage position, a second side panel, a second hinge rotatably coupling the second side panel to the top panel, wherein the second side panel is movable between an extended position and a storage position, a first storage position securing device for securing the first side panel in the storage position, and a second storage position securing device for securing the second side panel in the storage position.

14 Claims, 23 Drawing Sheets

FOLDING BREATH GUARD

BACKGROUND

The present invention relates generally to the field of breath guards for the foodservice industry. Breath guards provide a barrier between a person and food in a foodservice area, while providing relatively unrestricted access to the food for the customer and/or the foodservice staff. Breath guards at least partially cover, shield, screen, or protect the food in the foodservice area. Breath guards may also be referred to as breath shields, food guards, food shields, sneeze guards, or sneeze shields.

Frequently, breath guards are fixed in place for use as a barrier between the customer and the prepared food in a restaurant, cafeteria, buffet, salad bar, or other foodservice arrangement. A need exists for portable breath guards for use by caterers or others providing temporary foodservice arrangements that can be quickly and easily set up and taken down, as well as easily and compactly stored and transported.

SUMMARY

One embodiment of the invention relates to a folding breath guard configured to at least partially cover food in a foodservice area including a top panel, a first side panel, a first hinge rotatably coupling the first side panel to the top panel, wherein the first side panel is movable between an extended position and a storage position, a second side panel, a second hinge rotatably coupling the second side panel to the top panel, wherein the second side panel is movable between an extended position and a storage position, a first storage position securing device for securing the first side panel in the storage position, and a second storage position securing device for securing the second side panel in the storage position.

Another embodiment of the invention relates to a folding breath guard configured to at least partially cover food in a foodservice area including a top panel, a first side panel, a second side panel, a first hinge rotatably coupling the first side panel to the top panel, a second hinge rotatably coupling the second side panel to the top panel, the second hinge spaced apart from the first hinge, a first side wall extending from the top panel to a distal end, wherein the first side panel is positioned between the first side wall and the second side panel, a second side wall extending from the top panel to a distal end, wherein the second side panel is positioned between the second side wall and the first side panel, wherein, the first side panel is rotatable to a storage position in which no portion of the first side panel extends past the distal end of the first side wall or the distal end of the second side wall, and wherein, the second side panel is rotatable to a storage position in which no portion of the second side panel extends past the distal end of the first side wall or the distal end the second side wall.

Another embodiment of the invention relates to a folding breath guard configured to at least partially cover food in a foodservice area including a shield, a first leg, a first hinge rotatably coupling the first leg to the shield, wherein the first leg is movable between an extended position and a storage position, a second leg, a second hinge rotatably coupling the second leg to the shield, wherein the second leg is movable between an extended position and a storage position, a first storage position securing device for securing the first leg in the storage position, the first storage position securing device comprising a pair of magnetically attracted components, and a second storage position securing device for securing the second leg in the storage position, the second storage position securing device comprising a pair of magnetically attracted components.

Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings, in which.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

The folding breath guards described herein are portable and able to quickly and securely change between use and storage configurations. In some embodiments, major components of the breath guard are made from transparent materials, which improves user visibility of the food covered by the breath guard. Alternatively, some or all of the major components are made of translucent or opaque materials. A storage bag or case may be provided to store the breath guard in the storage configuration when not in use and to simplify transport of the breath guard to and from a desired location.

Figure 1:
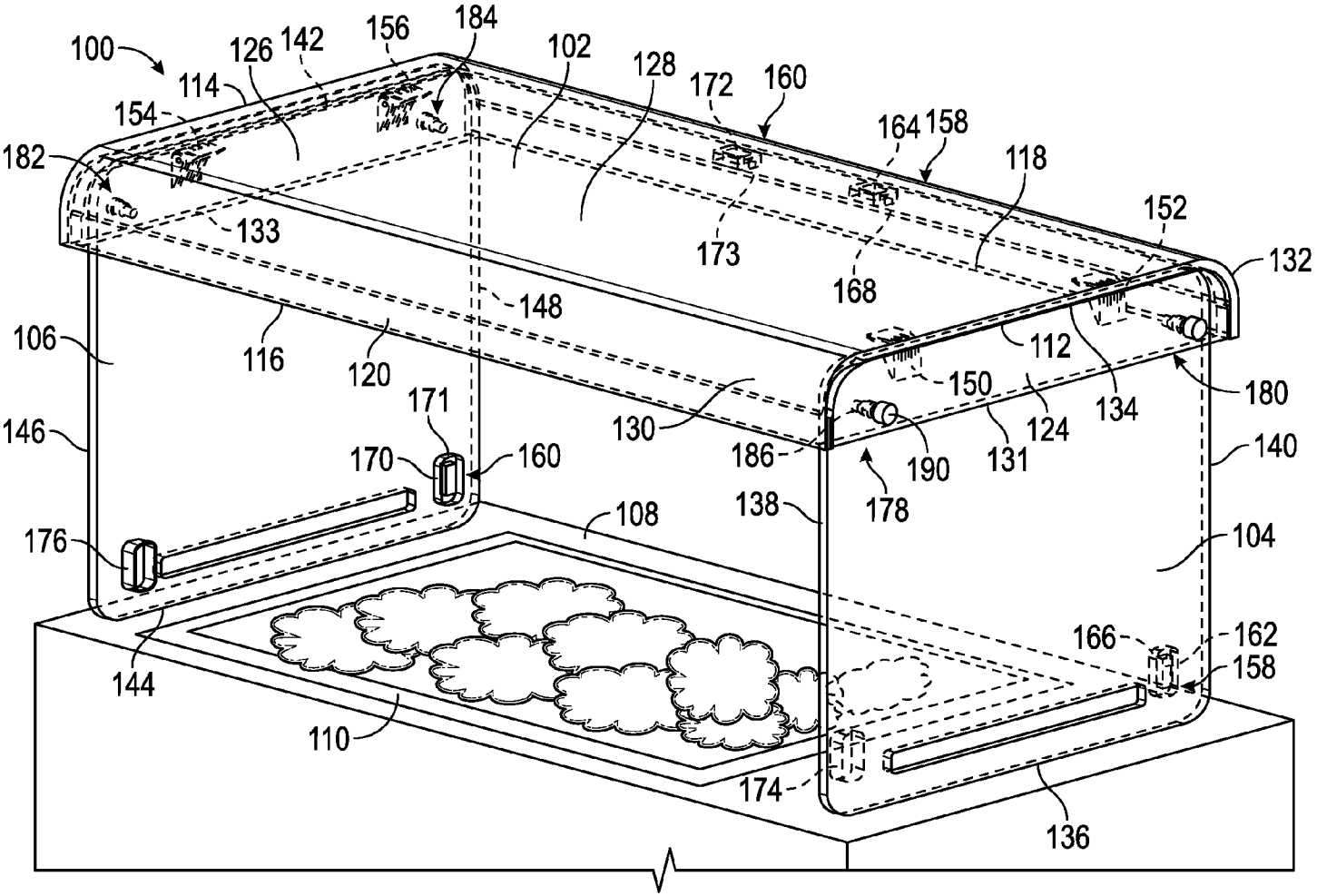
FIG. 1 is a perspective view of an exemplary folding breath guard and a foodservice area.
Figure 2:
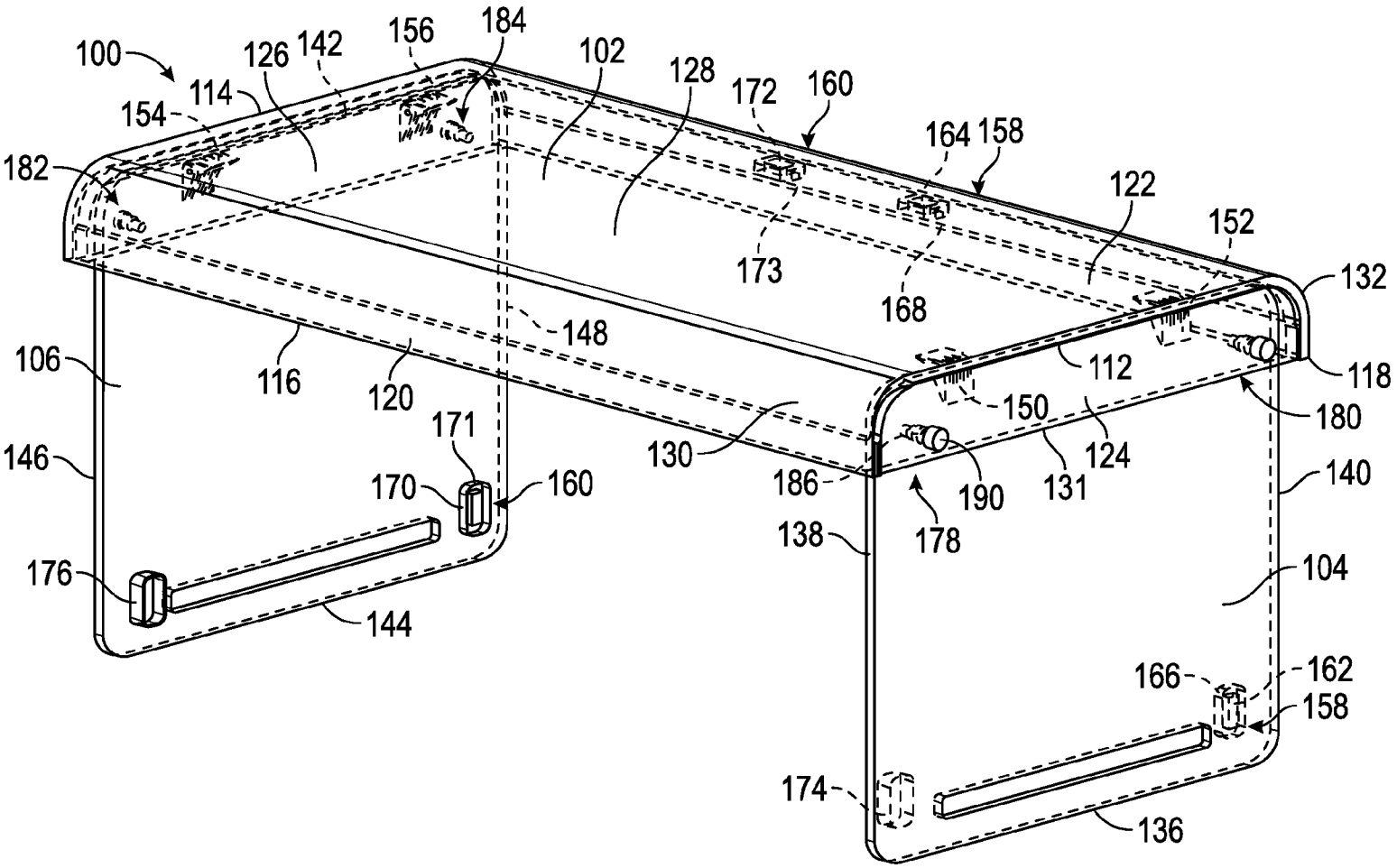
FIG. 2 is a perspective view of the breath guard of FIG. 1.
Figure 9:
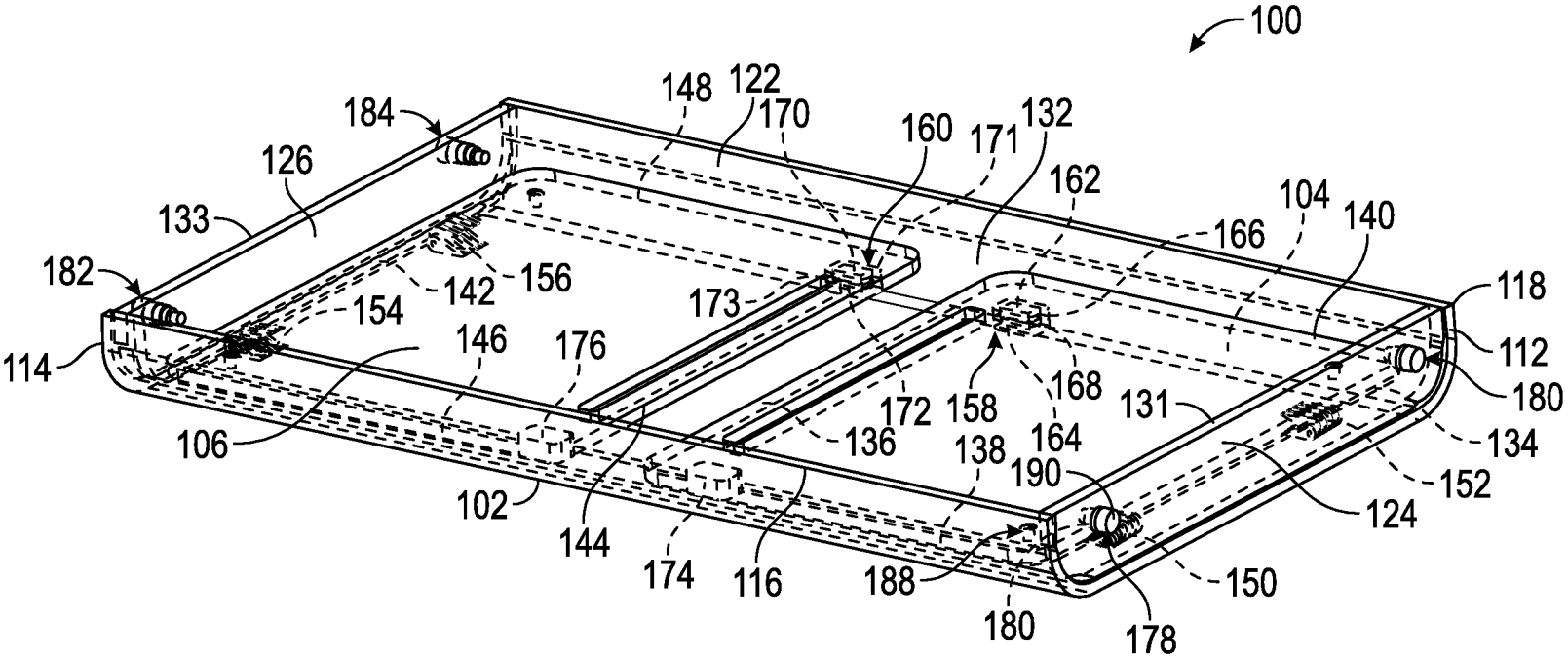
FIG. 9 is a perspective view from below of the breath guard of FIG. 1 with both supports in the storage position.

Referring to FIGS. 1-13, a folding breath guard 100 is illustrated according to an exemplary embodiment. Breath guard 100 includes a shield, cover, or barrier (e.g., top panel 102) supported by two side supports or legs (e.g., side support panels 104 and 106). Each of the side support panels 104 and 106 is movable (e.g., rotating, pivoting) between an extended position (e.g., as shown in FIG. 2) and a storage position (e.g., as shown in FIG. 9). With both side support panels 104 and 106 in their extended positions, breath guard 100 is in the use configuration. As shown in FIG. 1, with breath guard 100 in the use configuration, support panels 104 and 106 support top panel 102 at an elevation above a foodservice area (e.g., buffet 108 supporting food pan 110) thereby at least partially covering, shielding, screening, or protecting the food in the foodservice area. As shown in FIG. 9, with breath guard 100 in the storage configuration, breath guard 100 is relatively compact. The compact storage configuration results in breath guard 100 taking up less space when in the storage configuration than in the use configuration, making transport and storage of breath guard 100 easier and more convenient for the user. According to another exemplary embodiment, a third side support panel may be provided that is configured to be movable (e.g., rotating, pivoting) between an extended position and a storage position to provide additional support to the top panel and additional barrier to the food storage area.

Figure 10:
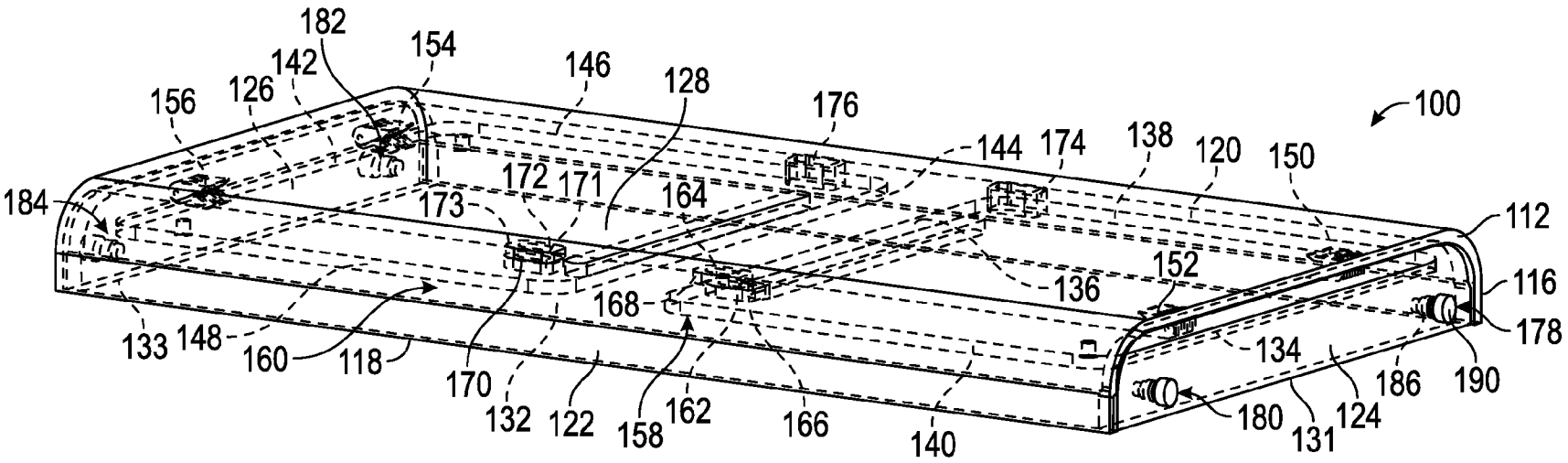
FIG. 10 is a perspective view from above of the breath guard of FIG. 1 with both supports in the storage position.
Figure 11:
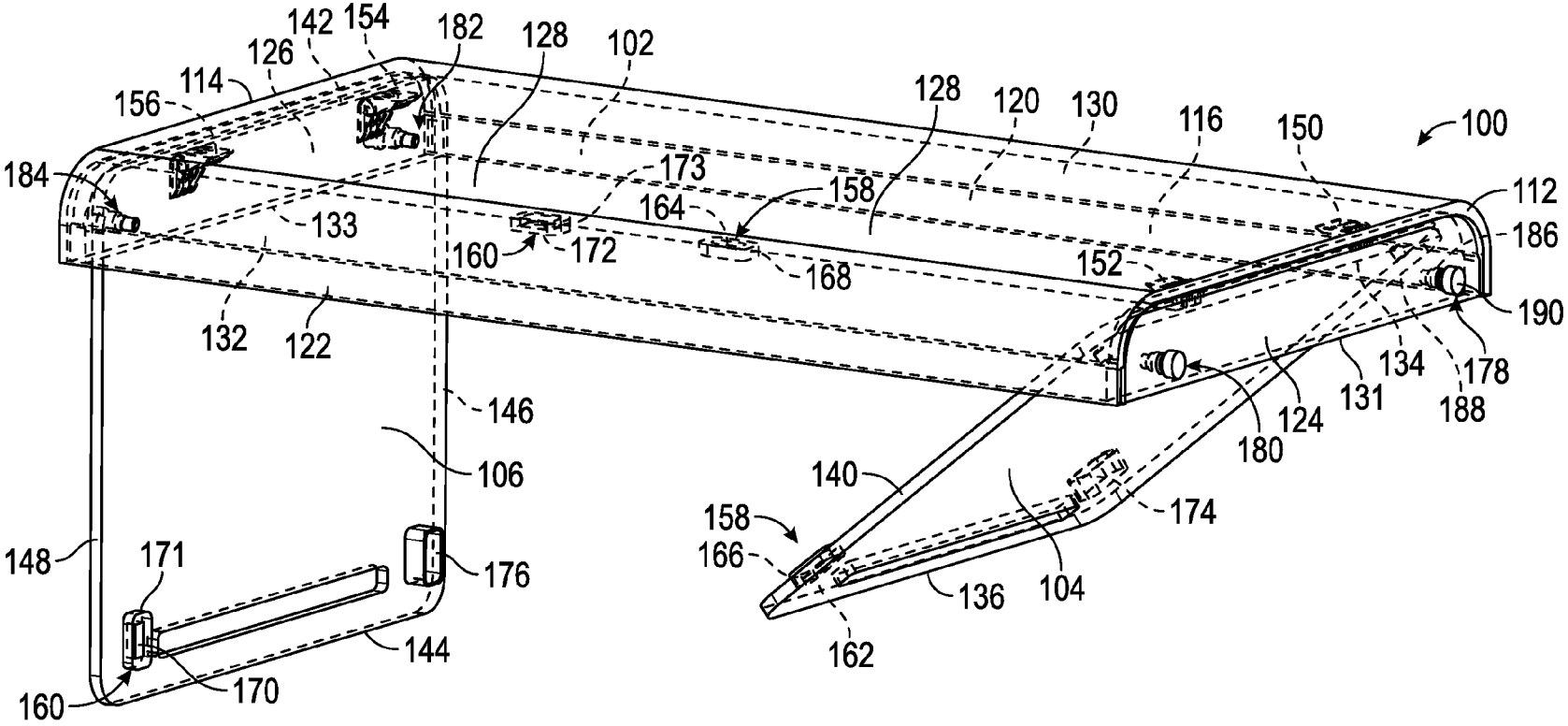
FIG. 11 is a perspective view from above of the breath guard of FIG. 1 with one support between the storage position and the extended position and the other support in the extended position.
Figure 12:
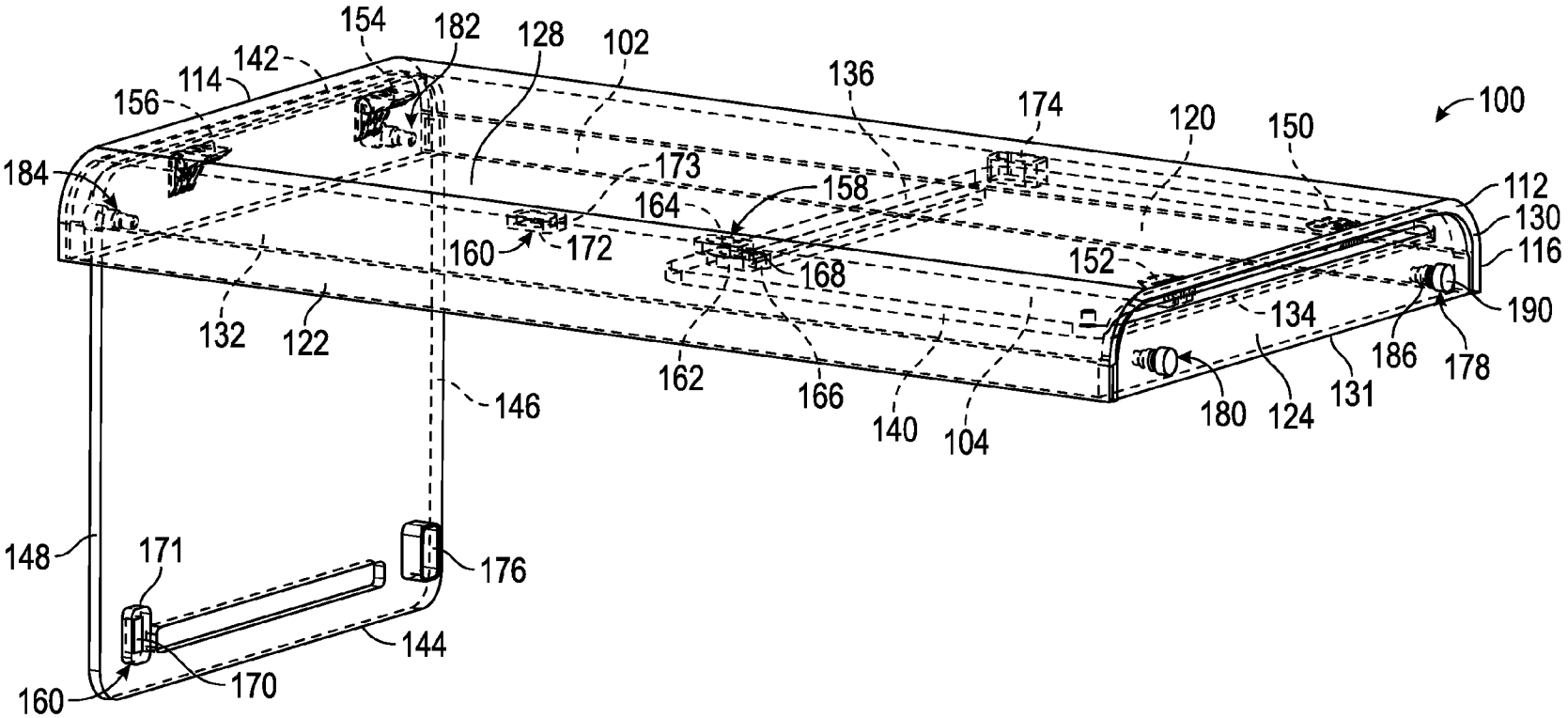
FIG. 12 is a perspective view from above of the breath guard of FIG. 1 with one support in the storage position and the other support in the extended position.
Figure 13:
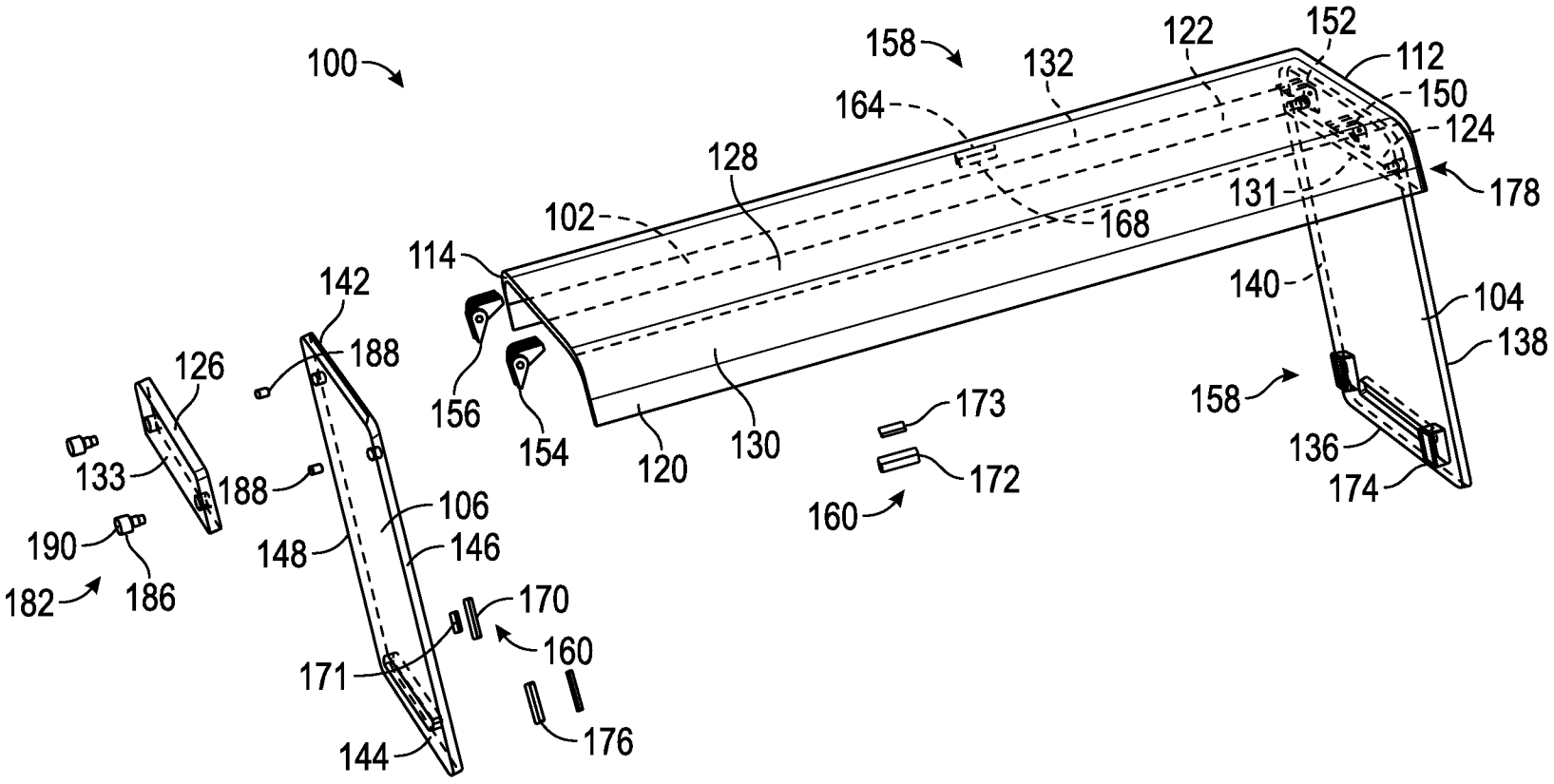
FIG. 13 is a partial exploded view of the breath guard of FIG. 1.
Figure 14:
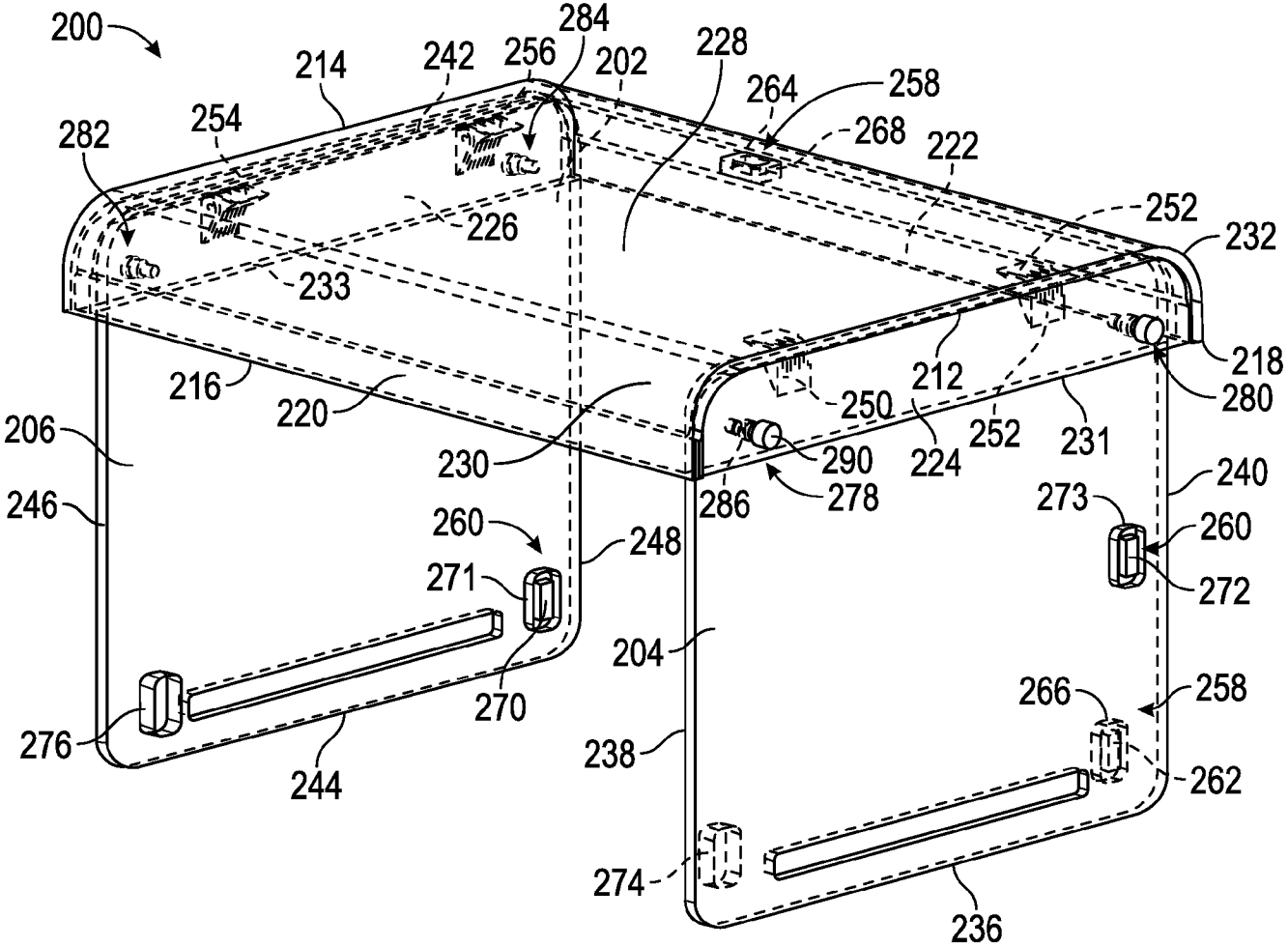
FIG. 14 is a perspective view of an exemplary folding breath guard.
Figure 15:
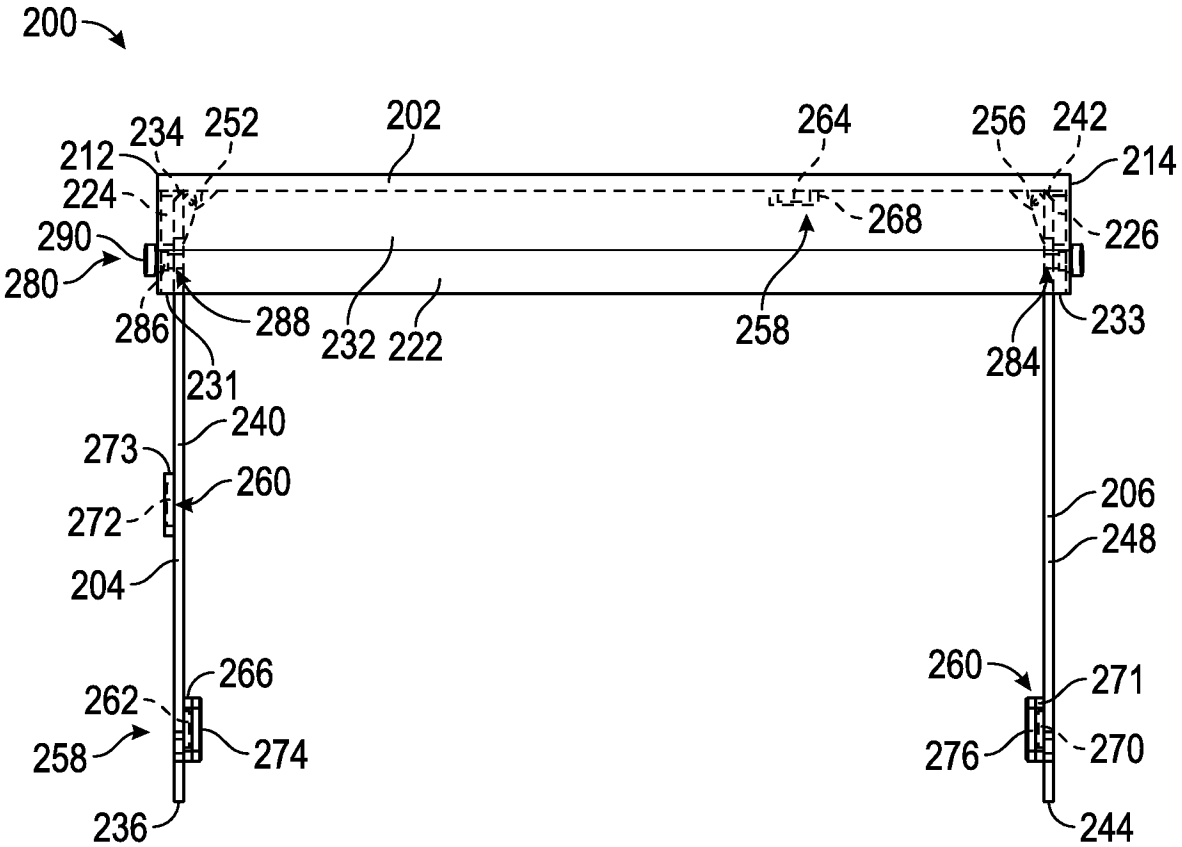
FIG. 15 is a rear view of the breath guard of FIG. 14.
Figure 16:
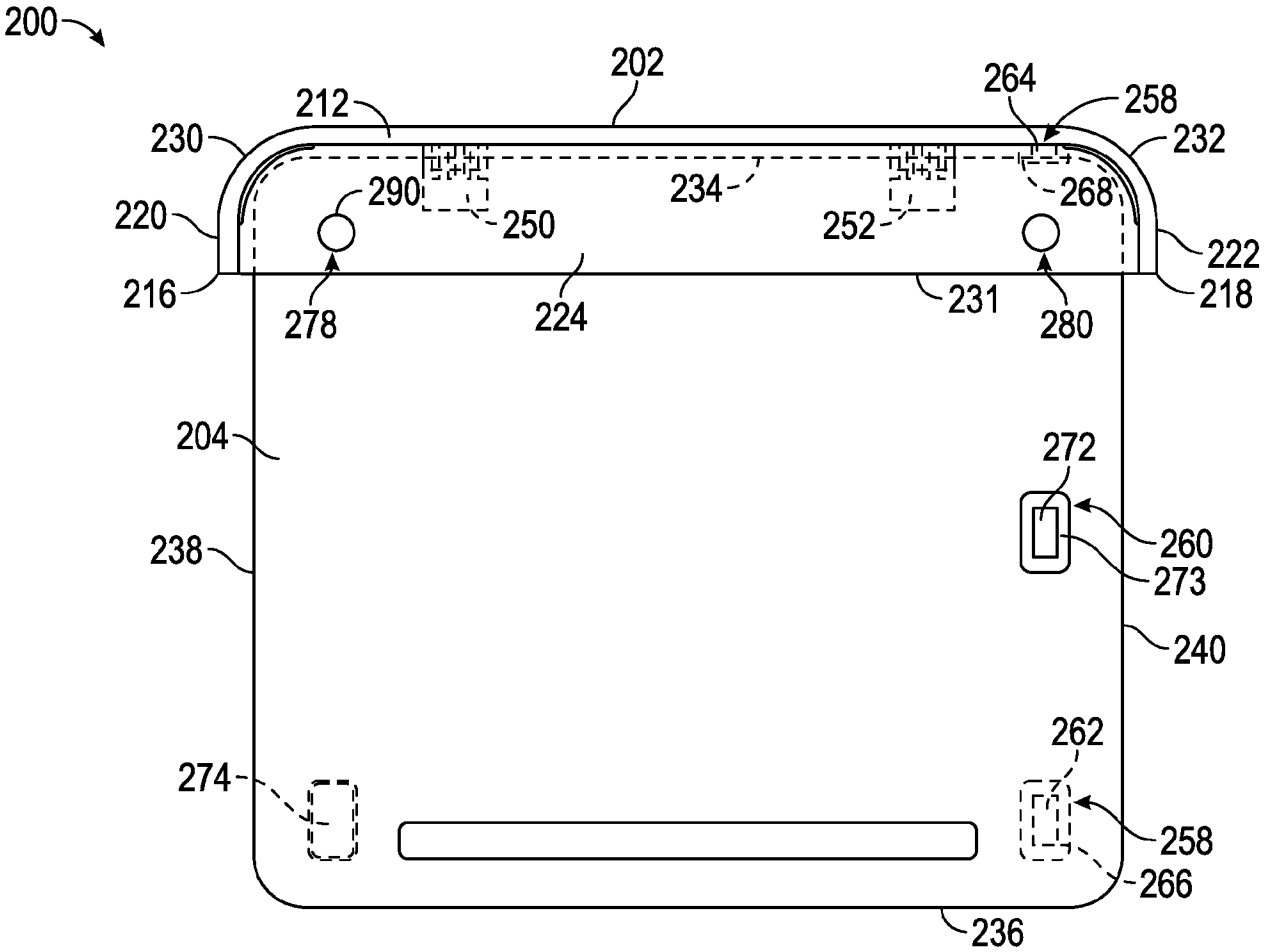
FIG. 16 is a right side view of the breath guard of FIG. 14.
Figure 17:
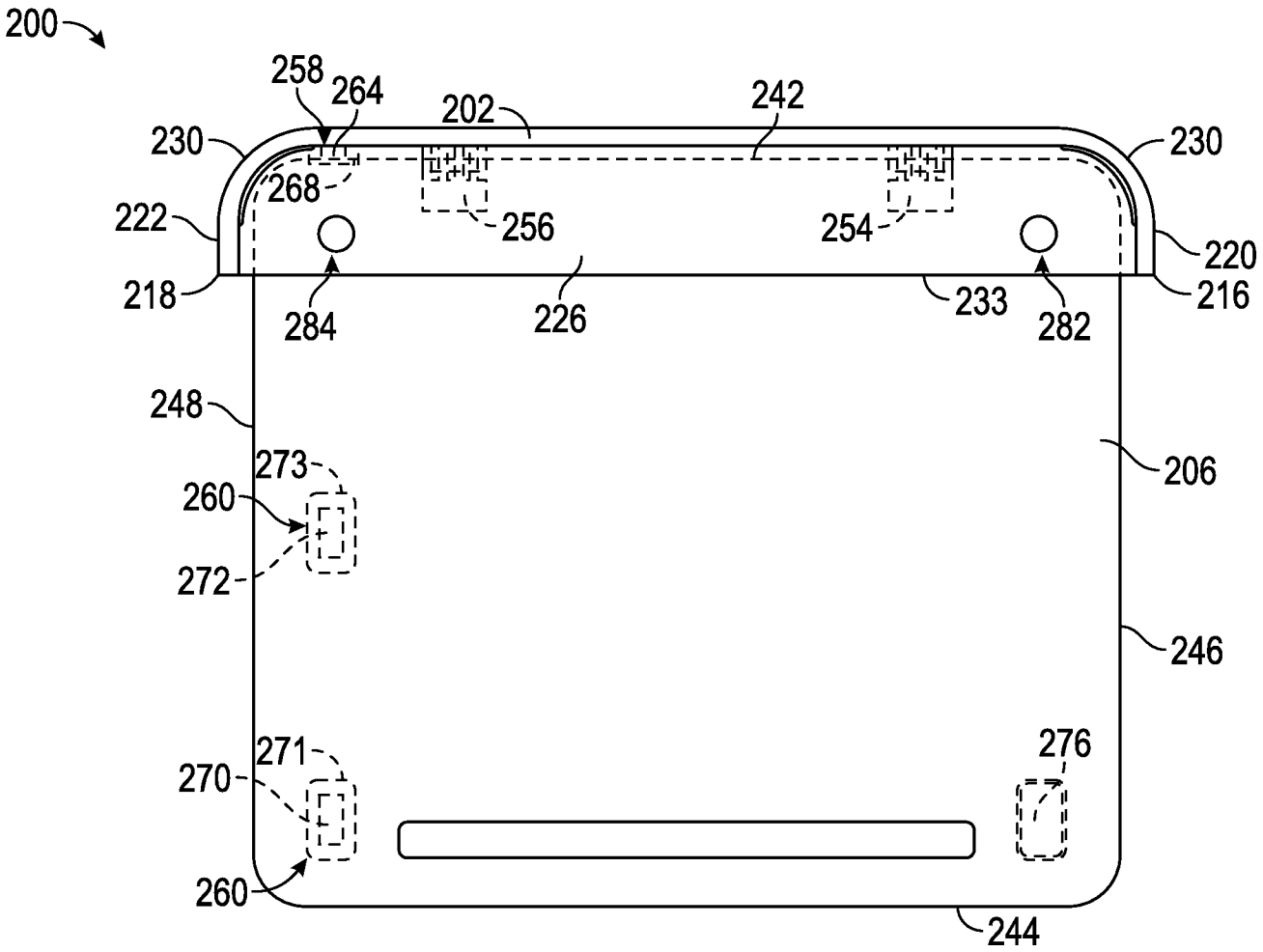
FIG. 17 is a left side view of the breath guard of FIG. 14.
Figure 18:
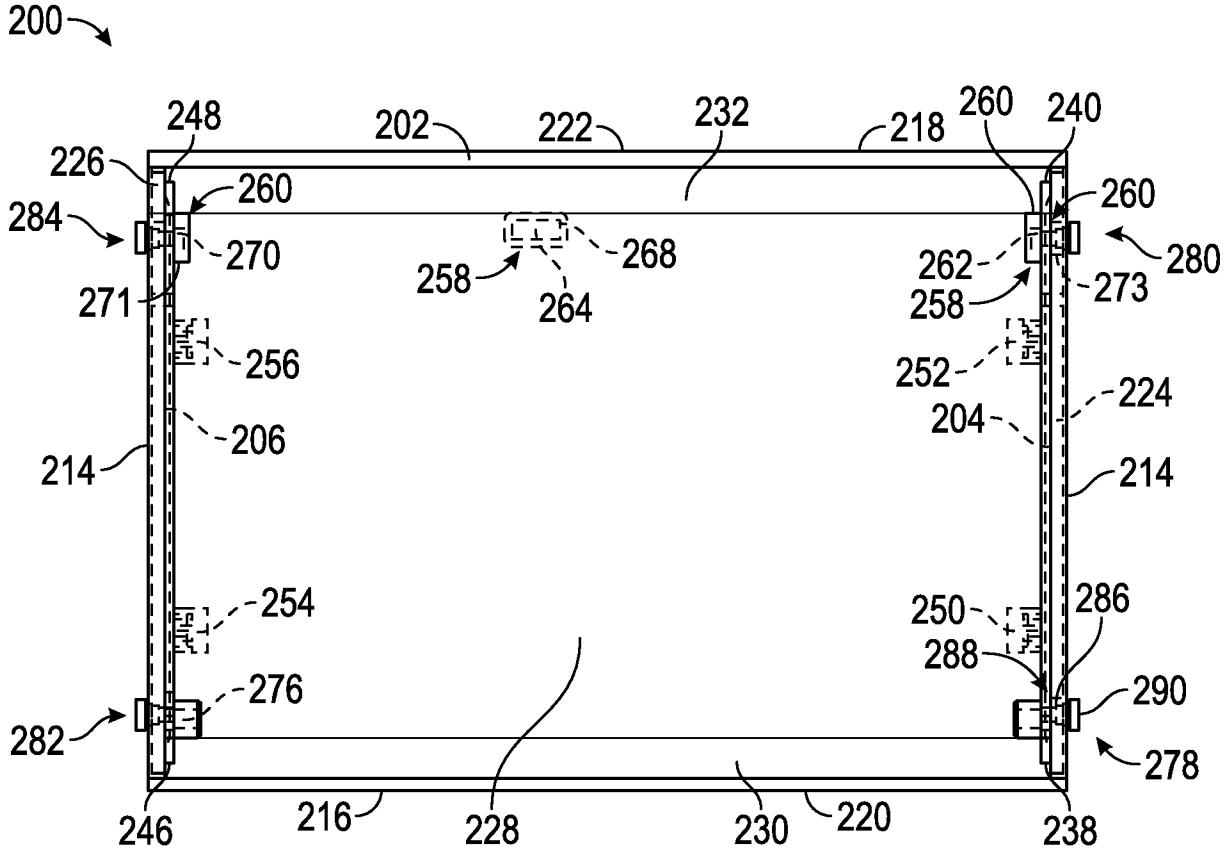
FIG. 18 is a top view of the breath guard of FIG. 14.
Figure 19:
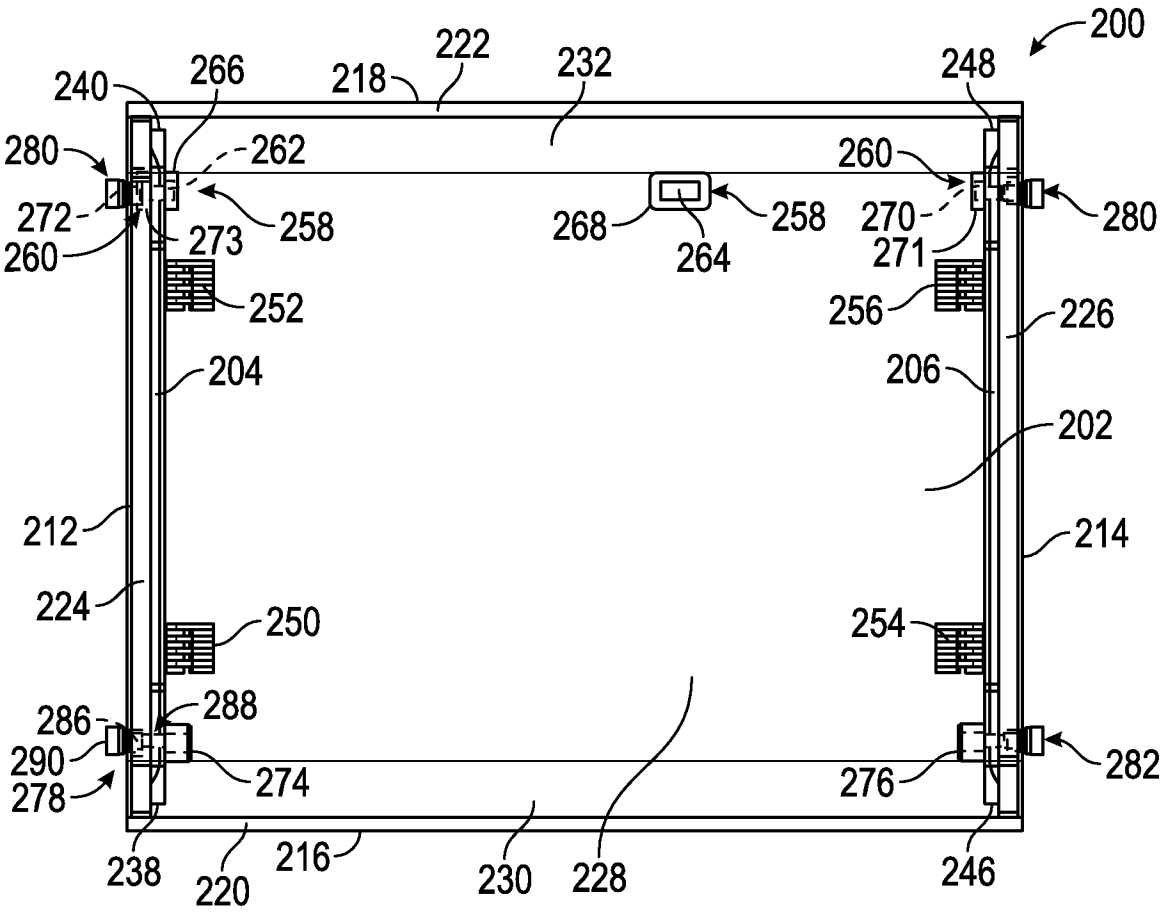
FIG. 19 is a bottom view of the breath guard of FIG. 14.

As illustrated, top panel 102 is substantially rectangular, having two longitudinal ends 112 and 114 and two transverse ends 116 and 118 with each end being substantially perpendicular to its adjacent ends and substantially parallel to its opposite end. A front wall 120, a rear wall 122, and a pair of side walls 124 and 126 extend downward relative to a central portion 128 of top panel 102. In some embodiments, front wall 120, rear wall 122, and central portion 128 are formed as a single unitary component with curved portions 130 and 132 connecting front wall 120 and rear wall 122, respectively to central portion 128. In other embodiments, front wall 120 and rear wall 122 are formed separately from central portion 128 and attached by appropriate fasteners (e.g., screws, pins, adhesive, etc.) and/or fastening techniques (e.g., welding, gluing, mortise and tenon, etc.). Side walls 124 and 126 extend downward from top panel 102 at or proximate ends 112 and 114, respectively. In some embodiments side walls 124 and 126 are formed as a single unitary component with central portion 128. In other embodiments, side walls 124 and 126 are formed separately from central portion 128 and attached by appropriate fasteners (e.g., screws, pins, adhesive, etc.) and/or fastening techniques (e.g., welding, gluing, mortise and tenon, etc.). As shown in FIGS. 9 and 10, each side wall 124 and 126 extends from top panel 102 to a distal end 131 and 133, respectively. Preferably, the height of side walls 124 and 126 (i.e., distance between inner surface of top panel 102 and ends 131 and 133, respectively) is such so that with side panels 104 and 106 each in its storage position, no portion of either side panel 104 and 106 extends past the ends 131 and 133 of the side walls 124 and 126. This arrangement helps to create a relatively compact storage configuration for breath guard 100 because the entirety of the breath guard is contained within a space bounded by top panel 102, front wall 120, rear wall 122, and side walls 124 and 126.

Side panel 104 is substantially rectangular, having two longitudinal ends 134 and 136 and two transverse ends 138 and 140 with each end being substantially perpendicular to its adjacent ends and substantially parallel to its opposite end. In some embodiments, side panel 104 has substantially the same width (i.e., distance between ends 138 and 140) as top panel 102 (i.e., distance between ends 116 and 118). This arrangement provides a side barrier (e.g., shield, screen, cover, protection) between the food in the foodservice area and users, thereby at least partially covering, shielding, screening, or protecting the food in the foodservice area. Side panel 106 is similar to side panel 104 and includes two longitudinal ends 142 and 144 and two transverse ends 146 and 148. In some embodiments side panels 104 and 106 or other side supports (e.g., legs) are narrower than the top panel 102.

Figure 3:
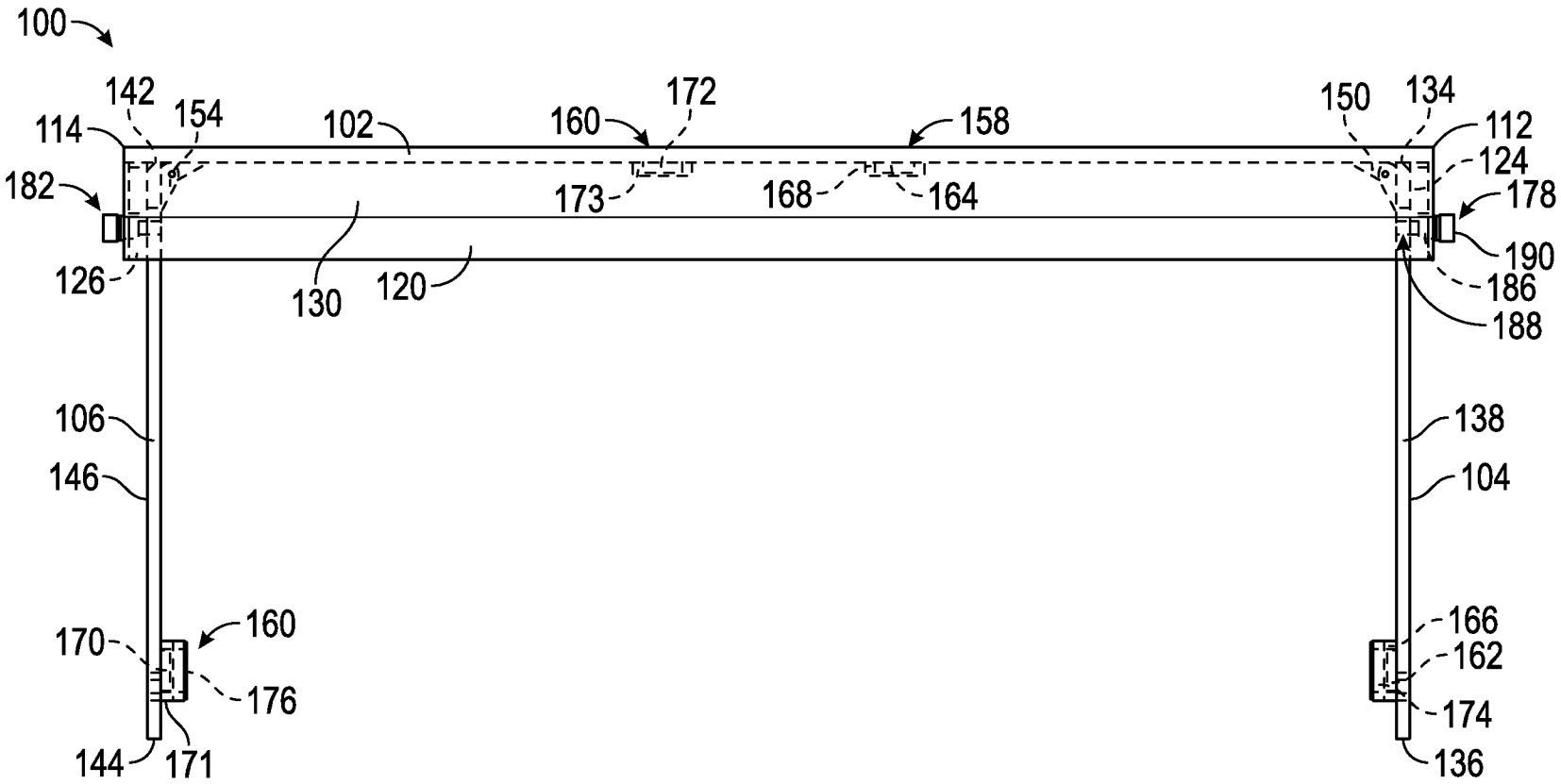
FIG. 3 is a front view of the breath guard of FIG. 1.
Figure 4:
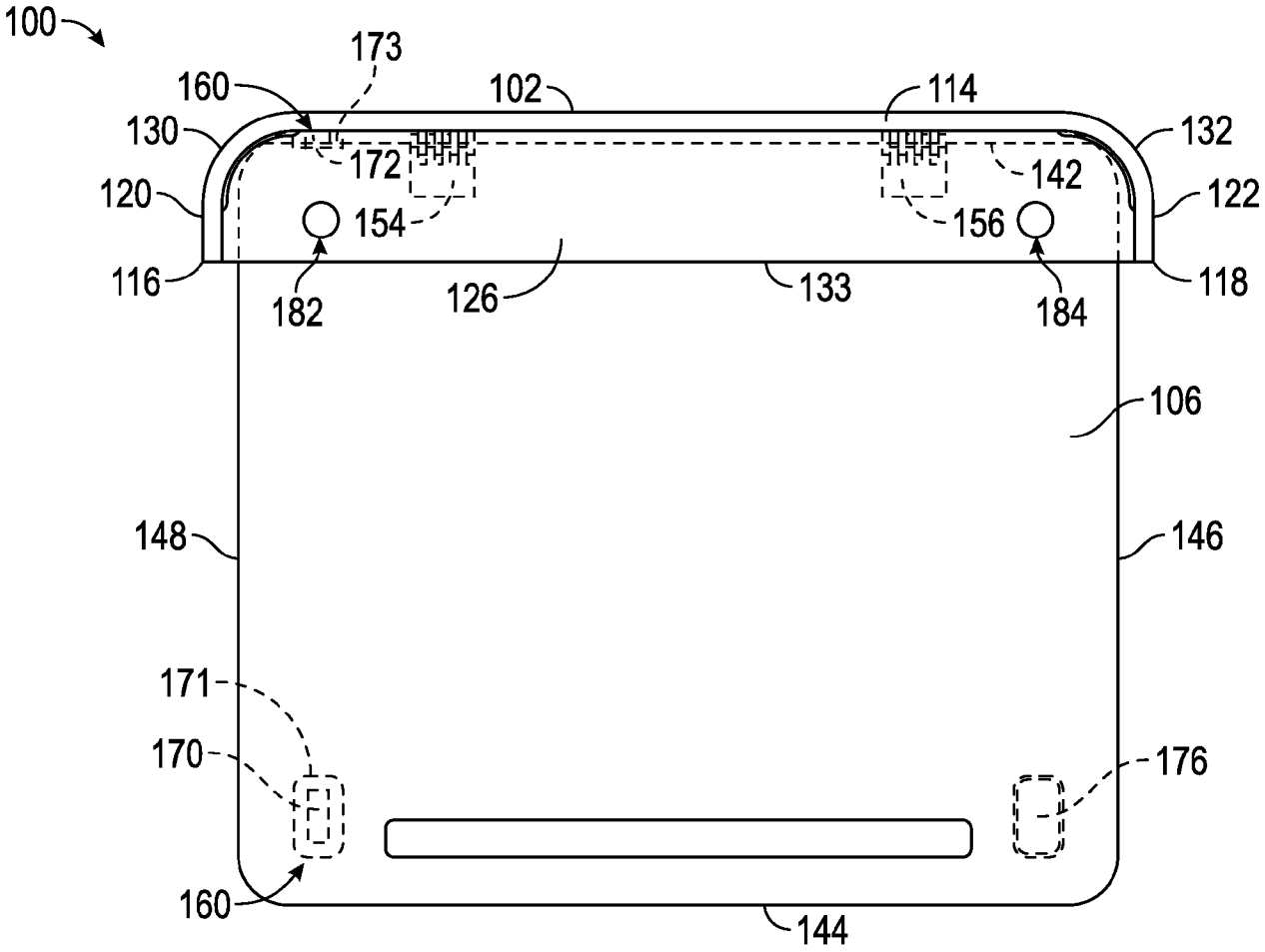
FIG. 4 is a left side view of the breath guard of FIG. 1.
Figure 5:
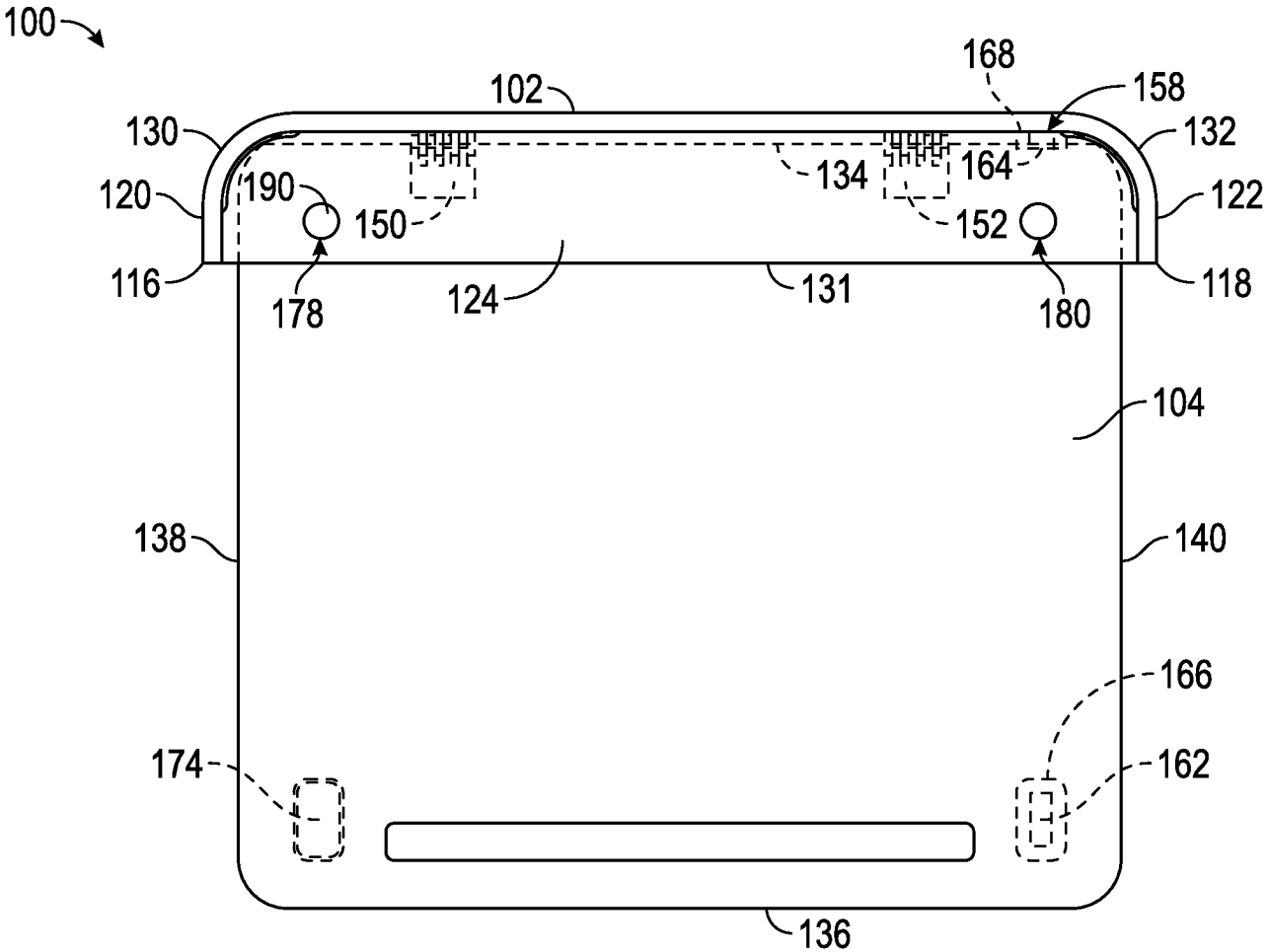
FIG. 5 is a right side view of the breath guard of FIG. 1.
Figure 6:
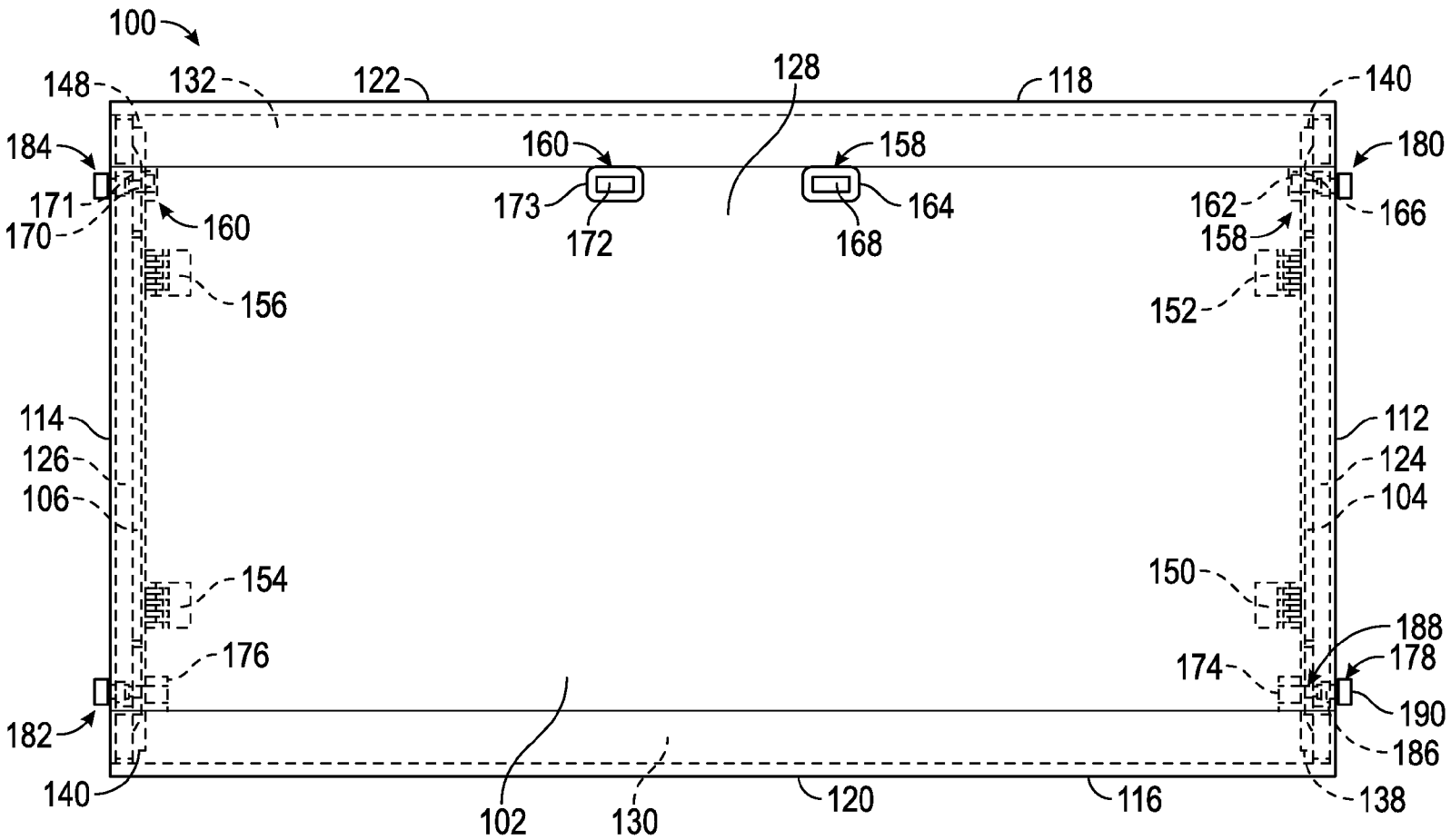
FIG. 6 is a top view of the breath guard of FIG. 1.
Figure 7:
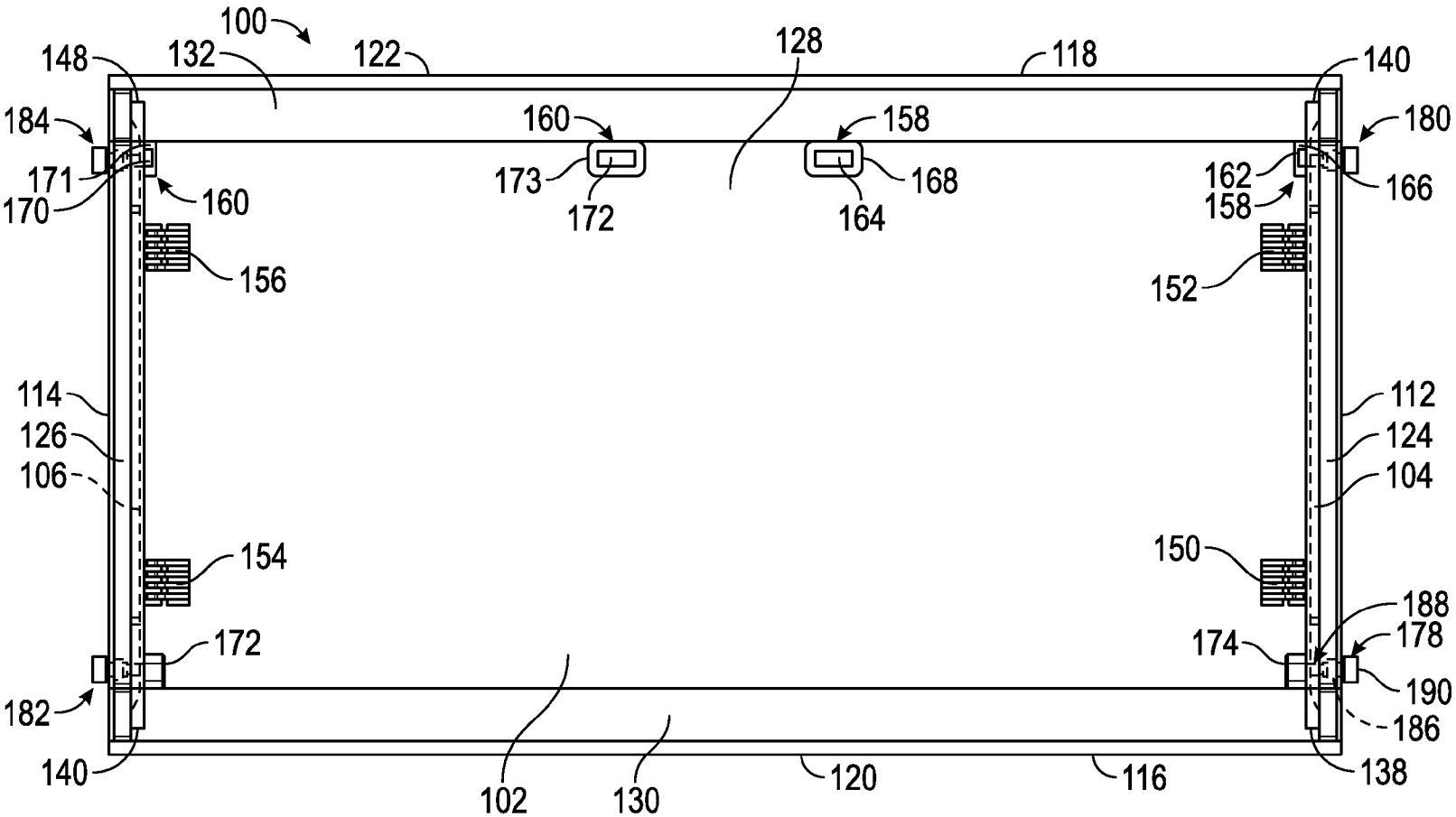
FIG. 7 is a bottom view of the breath guard of FIG. 1.
Figure 8:
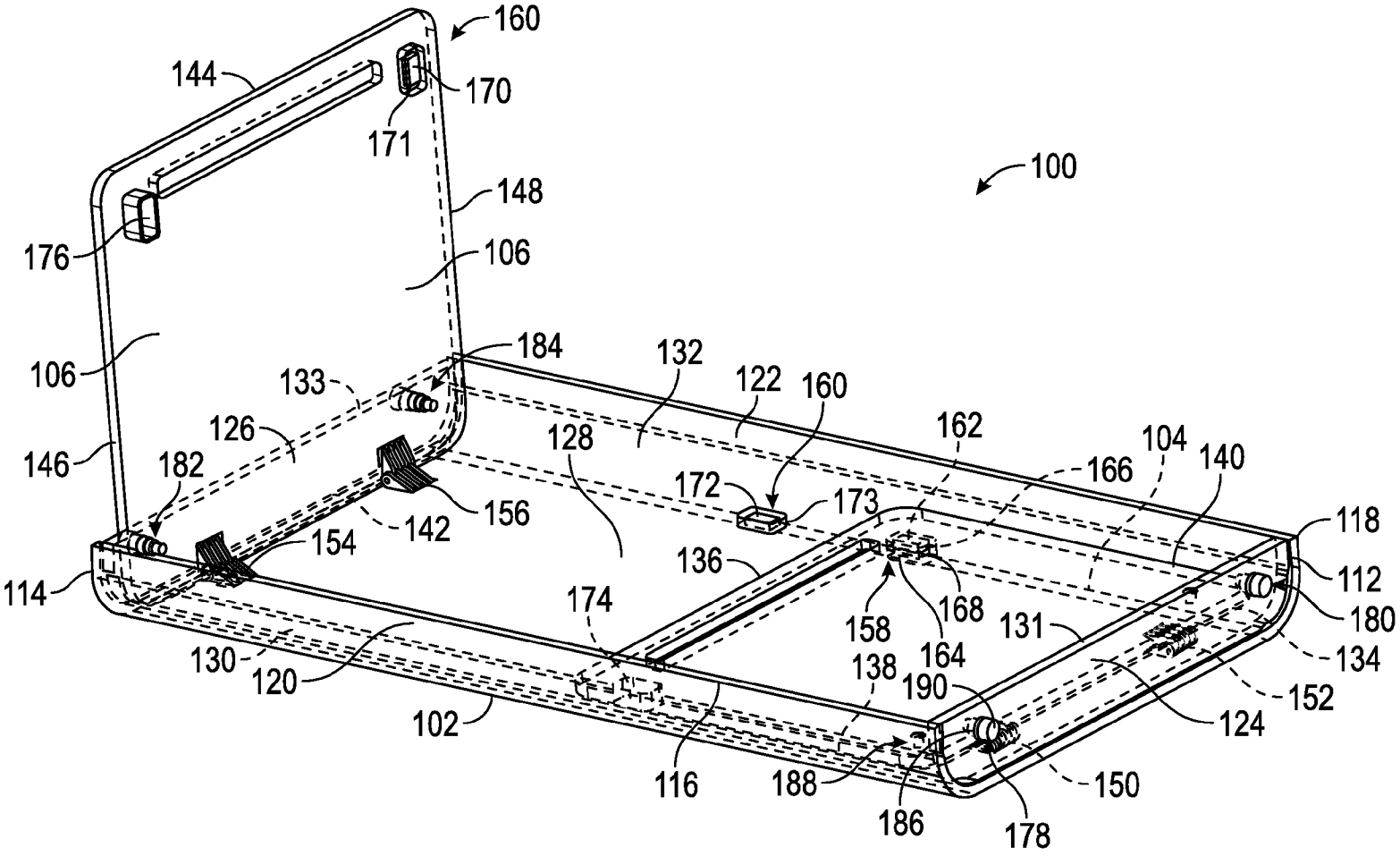
FIG. 8 is a perspective view from below of the breath guard of FIG. 1 with one support in the storage position and the other support in the extended position.

Side panel 104 is rotatably coupled to top panel 102 by a pair of hinges 150 and 152. Similarly, side panel 106 is rotatably coupled to top panel 102 by a pair of hinges 154 and 156. In some embodiments, more or fewer hinges may be used. Only hinge 150 will be described in detail; however, the other hinges are arranged in the same or similar manners. Hinge 150 is secured to top panel 102 (e.g., to the inner surface of the top panel) and to side panel 104 (e.g., to the inner surface of the side panel). Hinge 150 allows side panel 104 to move between the extended position (e.g., substantially perpendicular to top panel 102) and the storage position (e.g., substantially parallel to top panel 102). As shown in FIG. 3, hinge 150 is spaced apart (e.g., offset) from end 112 of top panel 102 so that side panel 104 is positioned between side wall 124 and side panel 106. Hinge 150 is positioned at or proximate end 134 of side panel 104. Hinges may be formed as any appropriate type of rotatable coupling, including butterfly, flush, barrel, continuous, piano, living, or other types of hinges.

Breath guard 100 also includes a pair of storage position securing devices 158 and 160. Securing device 158 secures side panel 104 to top panel 102 in the storage position. Similarly, securing device 160 secures side panel 106 to top panel 102 in the storage position. In an exemplary embodiment, securing devices 158 and 160 each include a pair of magnetically attracted components (i.e., a pair of magnets or a magnet and a metal component (e.g., plate, bar, etc.)). In some embodiments, rare earth magnets are utilized. In other embodiments, securing devices 158 and 160 take other appropriate forms (e.g., a pair of hook-and-loop fastener components, a snap assembly, a latch assembly, a removable fastener, a captive fastener, etc.). Magnetically attracted components are preferred because they reliably secure to one another, while still allowing relatively easy disengagement from one another. In this way, a user does not have to pull overly hard on a side panel to disengage the securing device and move the side panel from the storage position or move multiple components (e.g., a latch or a separate fastener) to disengage the securing device and move the side panel from the storage position.

In a preferred embodiment, securing device 158 includes a pair of magnetically attracted components 162 and 164. Component 162 is secured to side panel 104. As illustrated, component 162 is secured to the inner surface of side panel 104 and positioned within a mount or holder 166. In some embodiments, component 162 is secured within side panel 104. Component 164 is secured to top panel 102. As illustrated, component 164 is secured to the inner surface of top panel 102 and is positioned within a mount or holder 168. In some embodiments, component 164 is secured within top panel 102. Component 162 is spaced from ends 134 and 140 of side panel 104 and component 164 is spaced from ends 112 and 118 of top panel 102 so that component 162 is substantially aligned with component 164 when side panel 104 is in the storage position so that the magnetic attraction between components 162 and 164 secures side panel 104 to top panel 102 in the secured position. In a preferred embodiment, securing device 160 includes magnetically attracted components 170 and 172 and mounts 171 and 173 similar to components 162 and 164 mounts 166 and 168 described above.

A spacer or bumper 174 extends from the inner surface of side panel 104. Bumper 174 contacts top panel 102 when side panel 104 is in the storage position to space side panel 104 from top panel 102. A similar bumper 176 is provided for side panel 106. In the storage configuration, bumpers are configured to align and maintain some spacing between the panels to inhibit contact between and marring of the panels.

Breath guard 100 also includes four extended position securing devices 178, 180, 182, and 184 with a pair associated with each side panel 104 and 106. Securing devices 178 and 180 secure side panel 104 in the extended position. Similarly, securing devices 182 and 184 secure side panel 106 in the extended position. In some embodiments, more or fewer securing devices are used for each side panel. In an exemplary embodiment, securing devices 178, 180, 182, and 184 each include a captive fastener. In other embodiments, securing devices 178, 180, 182, and 184 take other appropriate forms (e.g., a pair of magnetically attracted components, a pair of hook-and-loop fastener components, a snap assembly, a latch assembly, a removable fastener, a captive fastener, etc.). Captive fasteners are preferred because they provide a relatively robust method of securing a side panel in the extended position so that accidental contact or jostling is less likely to cause the side panel to move from the extended position than other options. Captive fasteners are preferred over removable fasteners because the captive fastener stays connected to a component of the breath guard, eliminating the possibility for lost fasteners inherent with removable fasteners.

A preferred embodiment of securing devices 178, 180, 182, and 184 will be described with respect to securing device 178. Securing device 178 includes a captive fastener 186 and a corresponding aperture 188. As illustrated, captive fastener 186 is secured to side wall 124 and aperture 188 is formed in side panel 104. Alternatively, captive fastener 186 could be secured to side panel 104 and aperture 188 formed in side wall 124. Captive fastener 186 engages aperture 188 to secure side panel 104 to side wall 124 in the extended position. A user is able to manipulate captive fastener 186 to disengage aperture 188 without removing captive fastener 186 from the rest of breath guard 100. In some embodiments, captive fastener 186 is a threaded fastener and aperture 188 is threaded so that a user rotates the threaded fastener to engage/disengage it with aperture 188. In some embodiments, aperture 188 is defined in an insert is secured within side panel 104 or side wall 124 (e.g., the insert is press-fit or otherwise secured within an aperture formed in the side panel or the side wall). In some embodiments, captive fastener 186 is a movable pin biased towards aperture 188 when side panel 104 is in the extended position so that captive fastener 186 is biased to engage aperture 188. A user manipulates (e.g., pulls) the captive fastener 186 to disengage it from aperture 188. Captive fastener 186 includes a user interface portion 190 located in a position easily accessible by the user (e.g., positioned to the outside of side wall 124). User interface portion 190 may be configured to make it easy to operate by the user (e.g., include texturing, pull ring, or other appropriate feature).

In some embodiments, top panel 102 and side panels 104 and 106 are formed of transparent material. This improves user visibility of the food covered by breath guard 100. In a preferred embodiment, top panel 102 and side panels 104 and 106 are formed of transparent acrylic.

The dimensions of the folding breath guard may vary in different embodiments so that different sizes of breath guard may be used to cover different sizes of food service areas. For example, the length (i.e., distance between ends 112 and 114), width (i.e., distance between ends 116 and 118), and height (i.e. distance between ends 134 and 136) may vary as needed. In some embodiments (e.g., as illustrated in FIGS. 1-13), the length is about thirty-six inches, the width is about eighteen inches, and the height is about sixteen inches. In other embodiments (e.g., as illustrated in FIGS. 14-23), the length is about twenty-four inches, the width is about eighteen inches, and the height is about 16 inches. In other embodiments, the length is about forty-eight inches, the width is about eighteen inches, and the height is about 16 inches.

FIGS. 14-23 illustrate a folding breath guard 200 according to another exemplary embodiment. Breath guard 200 is shorter in length than breath guard 100. Components of breath guard 200 similar to those of breath guard 200 are referenced with the same number except in the 200s rather than the 100s.

Figure 20:
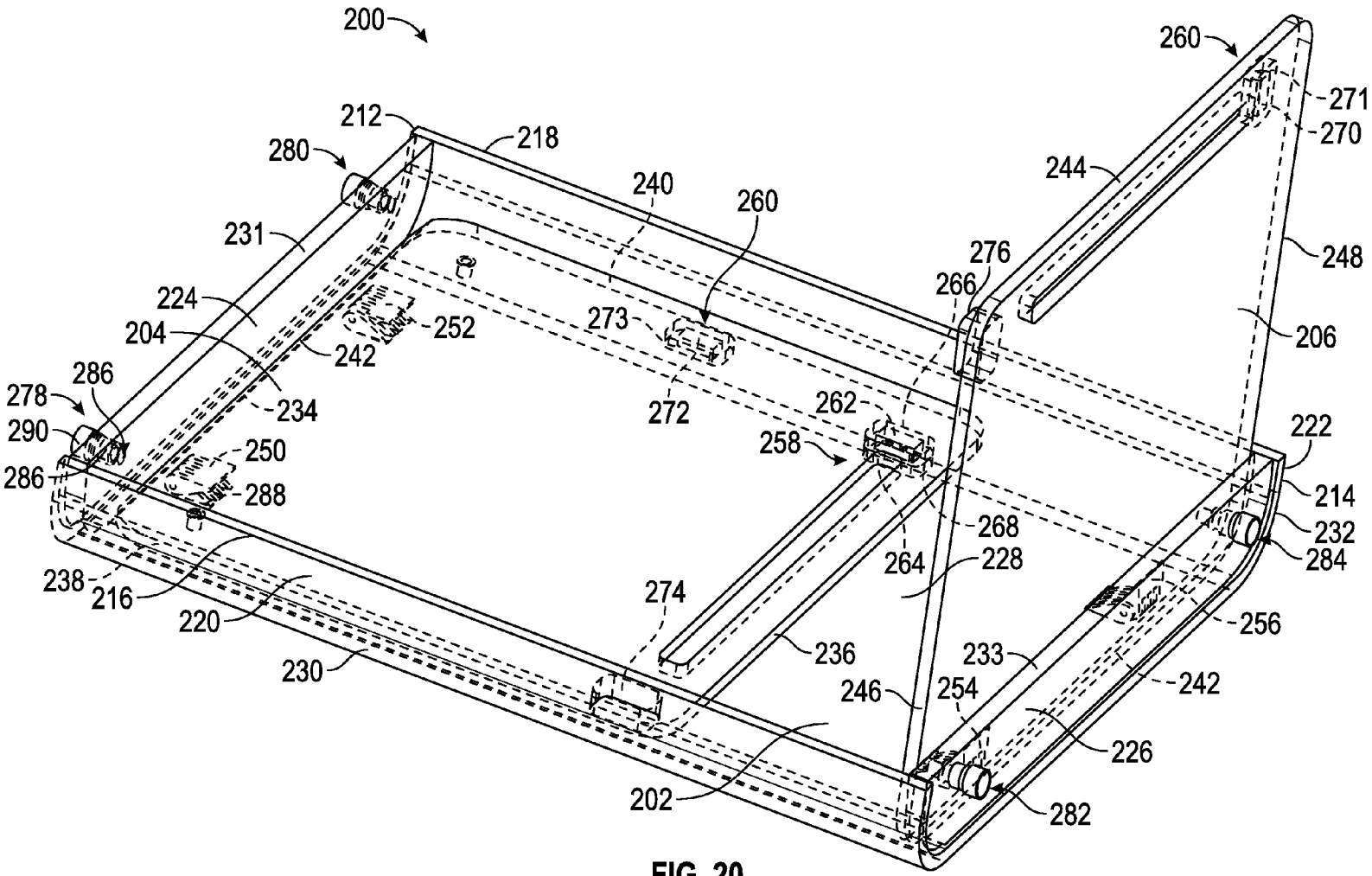
FIG. 20 is a perspective view from below of the breath guard of FIG. 14 with one support in the storage position and the other support in the extended position.

Due to the length of top panel 202 relative to the height of side panels 204 and 206, portions of side panels 204 and 206 overlap when side panels 204 and 206 are both in their respective storage position (e.g., as shown in FIG. 20). Because of this overlap, side panel 206 is angled relative to top panel 202 when in the storage position and side panel 204 is substantially parallel to top panel 202 when in the storage position. In the storage configuration of breath guard 200, a portion of side panel 204 is positioned between top panel 202 and a portion of side panel 206.

Compare the storage configuration of breath guard 200 (e.g., as shown in FIG. 20) with that of breath guard 100 (e.g., as shown in FIG. 9), in which side panels 104 and 106 do not overlap and are each substantially parallel to top panel 102. The differences in the storage configurations between breath guards 100 and 200 result in the storage position securing devices 258 and 260 being arranged differently than storage position securing devices 158 and 160.

In a preferred embodiment, securing device 258 includes a pair of magnetically attracted components 262 and 264. Component 262 is secured to side panel 204. As illustrated, component 262 is secured to the inner surface of side panel 204 and positioned within a mount or holder 266. In some embodiments, component 262 is secured within side panel 104. Component 264 is secured to top panel 202. As illustrated, component 264 is secured to the inner surface of top panel 202 and is positioned within a mount or holder 268. In some embodiments, component 264 is secured within top panel 202. Component 262 is spaced from ends 234 and 240 of side panel 204 and component 264 is spaced from ends 212 and 218 of top panel 202 so that component 262 is substantially aligned with component 264 when side panel 204 is in the storage position so that the magnetic attraction between components 264 and 264 secures the side panel 204 to top panel 202 in the secured position. Side panel 204 is substantially parallel to top panel 202 when in the storage position.

Securing device 260 includes a pair magnetically attracted components 270 and 272. Component 270 is secured to side panel 206. As illustrated, component 270 is secured to the inner surface of side panel 206 and positioned within a mount or holder 271. In some embodiments, component 270 is secured within side panel 206. Component 272 is secured to side panel 204. As illustrated, component 272 is secured to the outer surface of side panel 204 and is positioned within a mount or holder 273. In some embodiments, component 272 is secured within side panel 204. Component 270 is spaced from ends 244 and 248 of side panel 206 and component 272 is spaced from ends 236 and 240 of side panel 204 so that component 270 is substantially aligned with component 272 when side panel 206 is in the storage position and when side panel 204 is in the storage position so that the magnetic attraction between components 270 and 272 secures side panel 206 to side panel 204 in the secured position. Because portions of side panels 204 and 206 overlap when both are in their respective storage positions and a portion of side panel 204 is located between top panel 202 and a portion of side panel 206, side panel 206 is angled relative to top panel 202 when in the storage position.

Figure 21:
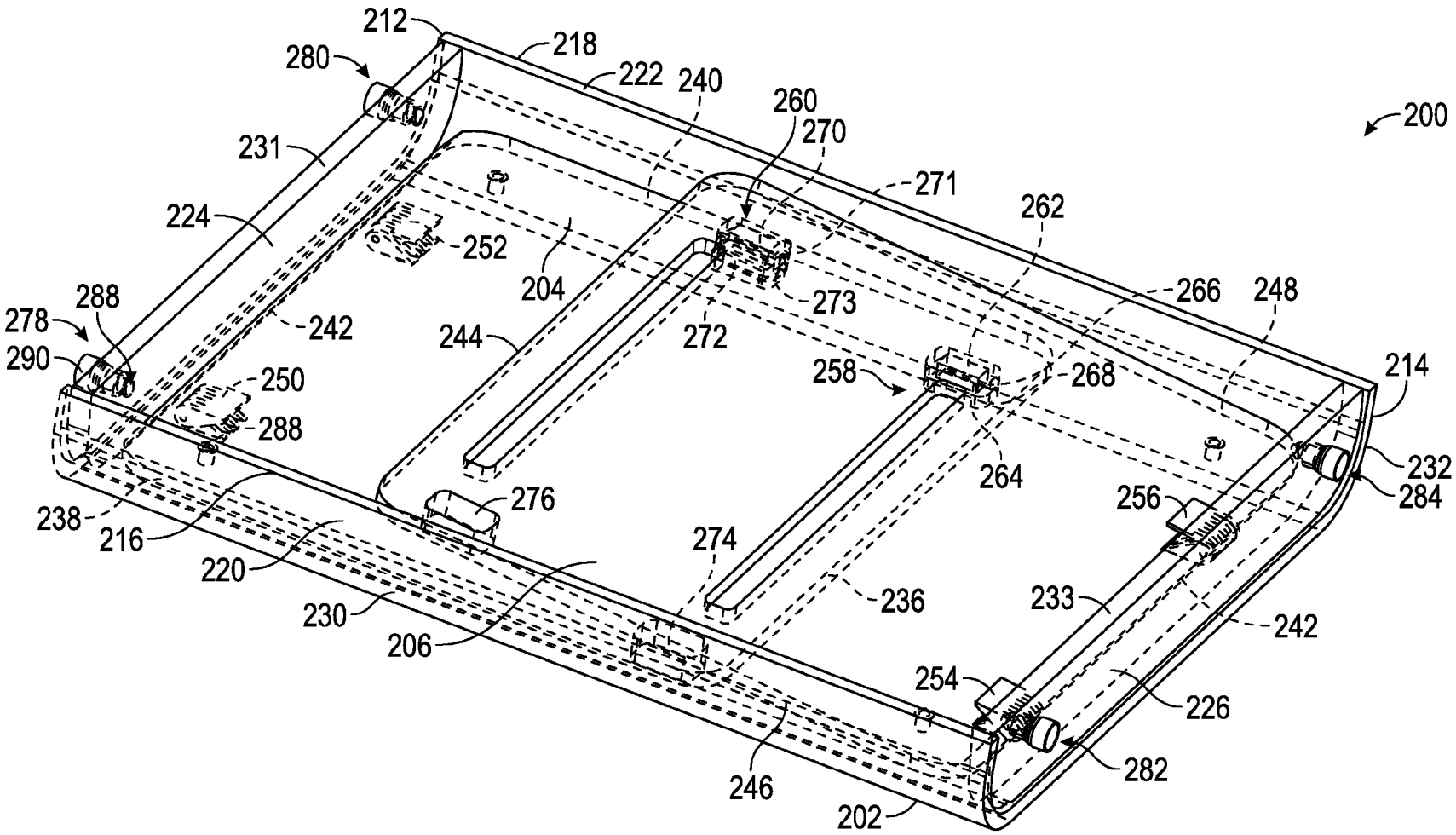
FIG. 21 is a perspective view from below of the breath guard of FIG. 14 with both supports in the storage position.
Figure 22:
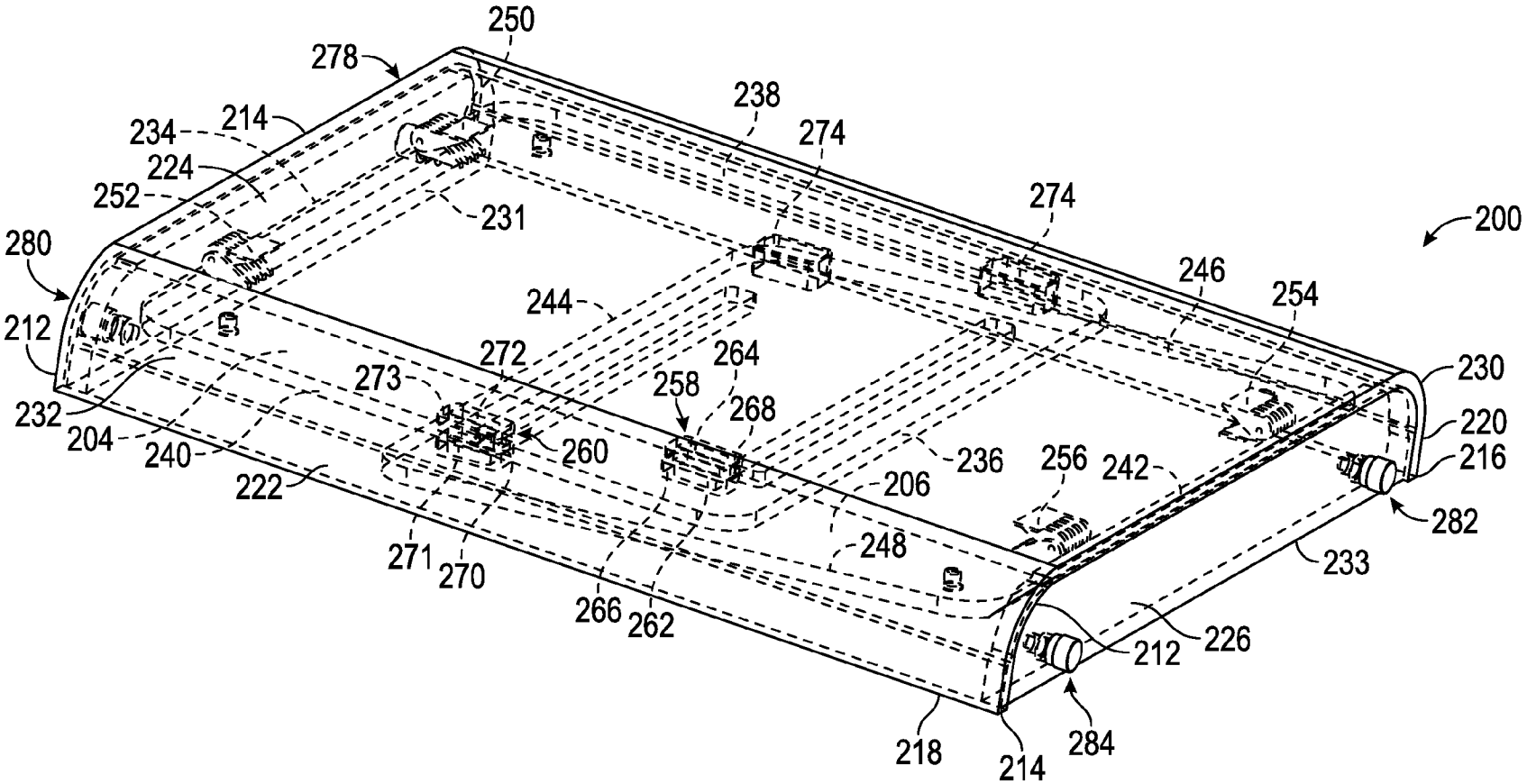
FIG. 22 is a perspective view from above of the breath guard of FIG. 14 with both supports in the storage position.
Figure 23:
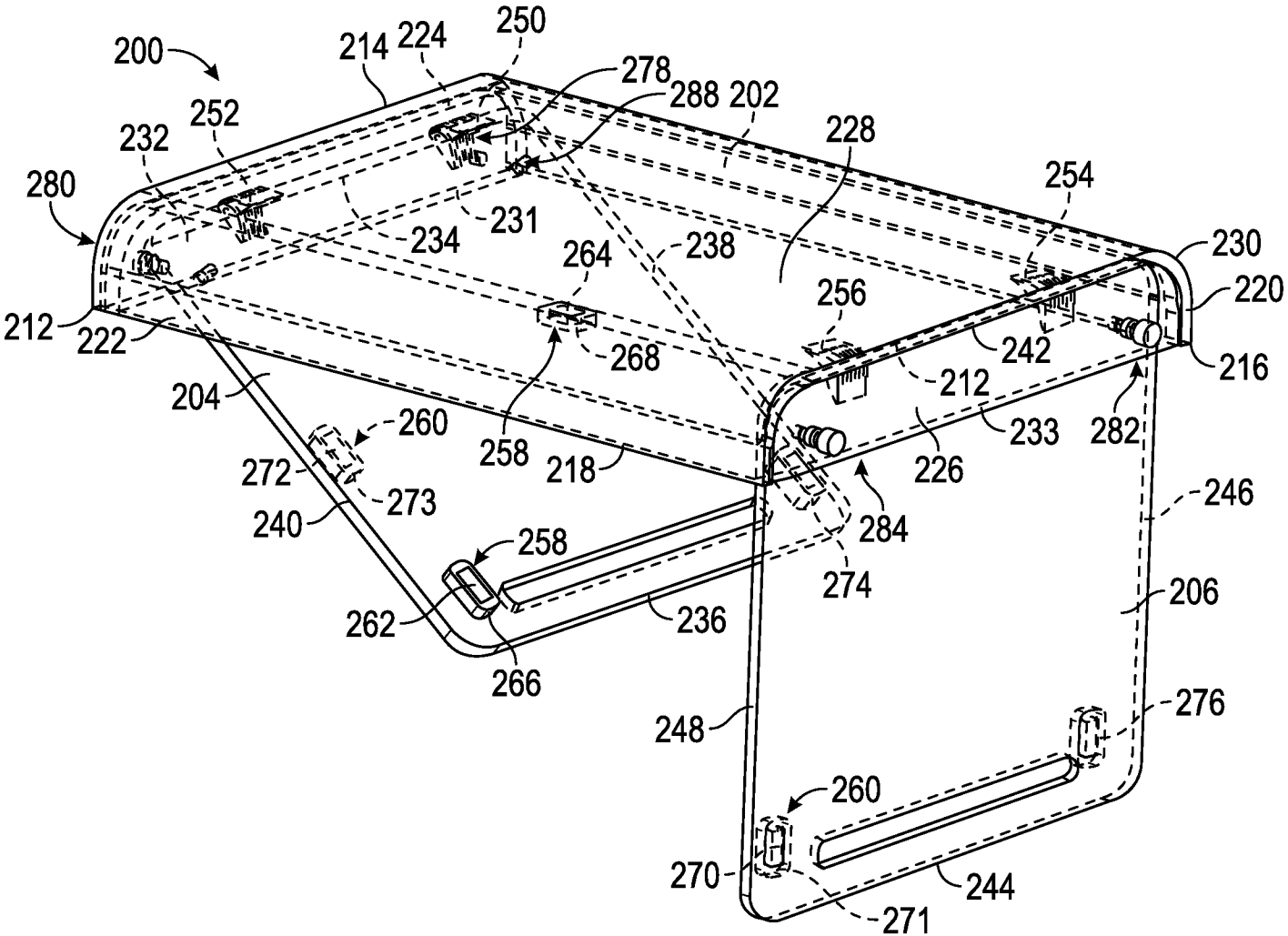
FIG. 23 is a perspective view from above of the breath guard of FIG. 14 with one support between the storage position and the extended position and the other support in the extended position.

As shown in FIGS. 21 and 22, the height of side walls 224 and 226 (i.e., distance between inner surface of top panel 202 and ends 231 and 233, respectively) is such so that with side panels 204 and 206 each in its storage position, no portion of either side panel 204 and 206 extends past the ends 231 and 233 of the side walls 224 and 226. This arrangement helps to create a relatively compact storage configuration for breath guard 200 because the entirety of the breath guard is contained within a space bounded by top panel 202, front wall 220, rear wall 222, and side walls 224 and 226.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

Although the figures may show or the description may provide a specific order of method steps, the order of the steps may differ from what is depicted. Also two or more steps may be performed concurrently or with partial concurrence. Such variation will depend on various factors. All such variations are within the scope of the disclosure.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges or geometric relationships provided. Accordingly, these terms should be interpreted as indicating that insubstantial or inconsequential modifications or alterations of the subject matter described and claimed are considered to be within the scope of the invention as recited in the appended claims.

The term "coupled" as used herein means the joining of two members directly or indirectly to one another. Such joining may be stationary (e.g., permanent) or moveable (e.g., removable, releasable, or rotatable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements as shown in the Figures. It should be noted that the orientation of various elements may differ according to other exemplary embodiments, and that such variations are intended to be encompassed by the present disclosure.

What is claimed is:

1. A folding breath guard configured to at least partially cover food in a foodservice area, comprising:

a top panel;

a first side wall extending downward from the top panel to a distal end;

a second side wall extending downward from the top panel to a distal end;

a first side panel extending between a first longitudinal end and a second longitudinal end;

a first hinge rotatably coupling the first side panel to the top panel, wherein the first side panel is movable between an extended position and a storage position;

a second side panel extending between a first longitudinal end and a second longitudinal end;

a second hinge rotatably coupling the second side panel to the top panel, wherein the second side panel is movable between an extended position and a storage position;

a first storage position securing device for securing the first side panel in the storage position; and a second storage position securing device for securing the second side panel in the storage position;

wherein with the first side panel in the extended position and the second side panel in the extended position, the first side panel is positioned between the first side wall and the second side panel; the second side panel is positioned between the second side wall and the first side panel; the distal end of the first side wall is positioned between the top panel and the second longitudinal end of the first side panel, and the distal end of the second side wall is positioned between the top panel and the second longitudinal end of the second side panel;

wherein, with the first side panel in the storage position, no portion of the first side panel extends past the distal end of the first side wall or the distal end of the second side wall; and wherein, with the second side panel in the storage position, no portion of the second side panel extends past the distal end of the first side wall or the distal end the second side wall; further comprising: a first extended securing position securing device for securing the first side panel in the extended position; and a second extended position securing device for securing the second side panel in the extended position; wherein the first extended position securing device comprises a captive fastener assembly secured to the first side wall and an aperture in the first side panel so that the captive fastener assembly engages the aperture to secure the first side panel in the extended position; and wherein the second extended position securing device comprises a captive fastener assembly secured to the second side wall and an aperture in the second side panel so that the captive fastener assembly engages the aperture to secure the second side panel in the extended position.

2. The folding breath guard of claim 1, wherein the first storage position securing device comprises a pair of magnetically attracted components, the first component secured to a lower surface of the top panel and the second component secured to an inner surface of the first side panel for magnetically securing the first side panel in the storage position; and wherein the second storage position securing device comprises a pair of magnetically attracted components, the first component secured to a lower surface of the top panel and the second component secured to an inner surface of the second side panel for magnetically securing the second side panel in the storage position.

3. The folding breath guard of claim 1, wherein the first storage position securing device comprises a pair of magnetically attracted components, the first component secured to a lower surface of the top panel and the second component secured to an inner surface of the first side panel for magnetically securing the first side panel in the storage position; and wherein the second storage position securing device comprises a pair of magnetically attracted components, the first component secured to an outer surface of the first side panel and the second component secured to an inner surface of the second side panel for magnetically securing the second side panel in the storage position.

4. The folding breath guard of claim 1, wherein the first side panel is substantially parallel to the top panel in the storage position; and wherein the second side panel is substantially parallel to the top panel in the storage position.

5. The folding breath guard of claim 1, wherein the first side panel is substantially parallel to the top panel in the storage position; and wherein the second side panel is angled relative to the top panel in the storage position.

6. The folding breath guard of claim 1, wherein the first side panel does not overlap with the second side panel when the first side panel is in the storage position and the second side panel is in the storage position.

7. The folding breath guard of claim 1, wherein a portion of the first side panel overlaps with a portion of the second side panel when the first side panel is in the storage position and the second side panel is in the storage position.

8. The folding breath guard of claim 1, further comprising:

a first bumper extending from an inner surface of the first side panel; and a second bumper extending from an inner surface of the second side panel.

9. The folding breath guard of claim 1, wherein the top panel, the first side panel, and the second side panel are transparent.

10. The folding breath guard of claim 1, wherein the top panel, the first side panel, and the second side panel are formed from transparent acrylic.

11. A folding breath guard configured to at least partially cover food in a foodservice area, comprising:

a top panel;

a first side panel extending between a first longitudinal end and a second longitudinal end;

a second side panel extending between a first longitudinal end and a second longitudinal end;

a first hinge rotatably coupling the first side panel to the top panel;

a second hinge rotatably coupling the second side panel to the top panel, the second hinge spaced apart from the first hinge;

a first side wall extending from the top panel to a distal end;

a second side wall extending from the top panel to a distal end;

wherein the first side panel is rotatable to an extended position and the second side panel is rotatable to an extended position in which the first side panel is positioned between the first side wall and the second side panel, the second side panel is positioned between the second side wall and the first side panel, the distal end of the first side wall is positioned between the top panel and the second longitudinal end of the first side panel, and the distal end of the second side wall is positioned between the top panel and the second longitudinal end of the second side panel;

wherein the first side panel is rotatable to a storage position in which no portion of the first side panel extends past the distal end of the first side wall or the distal end of the second side wall; and wherein the second side panel is rotatable to a storage position in which no portion of the second side panel extends past the distal end of the first side wall or the distal end the second side wall; further comprising: a first extended securing position securing device comprising a captive fastener assembly secured to the first side wall and an aperture in the first side panel so that the captive fastener assembly engages the aperture to secure the first side panel in the extended position; and a second extended position securing device comprising a captive fastener assembly secured to the second side wall and an aperture in the second side panel so that the captive fastener assembly engages the aperture to secure the second side panel in the extended position.

12. The folding breath guard of claim 11, further comprising:

a first storage position securing device for securing the first side panel in the storage position; and a second storage position securing device for securing the second side panel in the storage position.

13. The folding breath guard of claim 11, wherein the first side panel is substantially parallel to the top panel in the storage position; and wherein the second side panel is substantially parallel to the top panel in the storage position.

14. The folding breath guard of claim 11, wherein the first side panel is substantially parallel to the top panel in the storage position; and wherein the second side panel is angled relative to the top panel in the storage position.

* * * * *